US005454555A

United States Patent [19]

Kiyohara et al.

[11] Patent Number: 5,454,555

[45] Date of Patent: Oct. 3, 1995

[54] RECORDING APPARATUS

[75] Inventors: Takehiko Kiyohara, Zama; Tetsuhiro Nitta, Yokohama; Makoto Kashimura, Tokyo; Hirofumi Hirano, Yokohama; Toshihiko Bekki, Kawasaki; Tetsuo Kimura, Sagamihara, all of Japan

[73] Assignee: Canon kabushiki Kaisha, Tokyo, Japan

[21] Appl. No.: 179,821

[22] Filed: Jan. 11, 1994

Related U.S. Application Data

[63] Continuation of Ser. No. 921,401, Jul. 30, 1992, abandoned, which is a continuation of Ser. No. 582,404, Sep. 14, 1990, abandoned.

[30] Foreign Application Priority Data

| | | | |
|---|---|---|---|
| Sep. 18, 1989 | [JP] | Japan | 1-241371 |
| Sep. 18, 1989 | [JP] | Japan | 1-241372 |
| Sep. 18, 1989 | [JP] | Japan | 1-241373 |
| Sep. 18, 1989 | [JP] | Japan | 1-241378 |
| Sep. 18, 1989 | [JP] | Japan | 1-241379 |
| Sep. 18, 1989 | [JP] | Japan | 1-241380 |
| Sep. 18, 1989 | [JP] | Japan | 1-241381 |

[51] Int. Cl.[6] ..... B65H 5/26

[52] U.S. Cl. ..... 271/9; 271/126; 271/145; 271/3.14; 400/605; 400/625; 400/680

[58] Field of Search ..... 271/3, 3.1, 4, 9, 271/145, 162, 163, 164, 126, 127; 364/136; 400/23, 24, 29, 605, 624–625, 634, 636, 680, 691, 693, 692

[56] References Cited

U.S. PATENT DOCUMENTS

| | | | |
|---|---|---|---|
| 4,164,376 | 8/1979 | Yarp | 400/605 |
| 4,372,699 | 2/1983 | Quinn, Jr. | 271/3 |
| 4,488,829 | 12/1984 | Hidaka | 271/9 |
| 4,577,984 | 3/1986 | Yamamoto et al. | 271/3 |
| 4,619,388 | 10/1986 | Ono et al. | 271/145 X |
| 4,634,265 | 1/1987 | Tada | 271/3.1 X |
| 4,729,683 | 3/1988 | Staniszenski | 271/9 X |
| 4,772,007 | 9/1988 | Kashimura | 271/22 |
| 4,854,757 | 8/1989 | Kikuchi | 271/3 |
| 4,946,298 | 8/1990 | Oka et al. | 400/605 |
| 4,968,016 | 11/1990 | Koyama | 271/162 X |
| 4,986,525 | 1/1991 | Takagi et al. | 271/4 |
| 4,995,745 | 2/1991 | Yokoi et al. | 400/625 |
| 5,085,422 | 2/1992 | Sagara | 271/162 |
| 5,120,045 | 6/1992 | Kamezaki et al. | 271/162 |

FOREIGN PATENT DOCUMENTS

| | | | |
|---|---|---|---|
| 61-173969 | 8/1986 | Japan . | |
| 60525 | 3/1989 | Japan | 271/162 |
| 2138785 | 10/1984 | United Kingdom . | |

OTHER PUBLICATIONS

Dunning, "Mechanism for Latching a Paper Sheet Feeder to a Typewriter", Dec. 1981, IBM Tech. Disc. Bull., p. 3963.

*Primary Examiner*—H. Grant Skaggs
*Attorney, Agent, or Firm*—Fitzpatrick, Cella, Harper & Scinto

[57] ABSTRACT

The present invention provides a horizontally set recording apparatus provided with a sheet inserting and discharging holes at the upper surface, wherein substantially linear recording sheet transporting route passing through the recording section is formed, and an automatic sheet feeding apparatus can be removably attached thereon. The recording sheet is delivered into an inlet opening of said transporting route.

28 Claims, 15 Drawing Sheets

RECORDING APPARATUS

This application is a continuation of application Ser. No. 07/921,401, filed Jul. 30. 1992, now abandoned, which is a continuation of application Ser. No. 07/582,404, filed Sep. 14, 1990, now abandoned.

BACKGROUND OF THE INVENTION

1. Field of the Invention

The present invention relates to a recording apparatus or more precisely, for example, to the recording apparatus on which an automatic sheet feeding apparatus may be freely fixed or unfixed.

2. Related Background Art

Recording apparatus such as printer, copying machine, facsimile etc. are so constructed that an image composed of dot pattern is recorded on the recording sheet such as paper or thin plastic sheet by driving the energy generating member of the recording head according to the transmitted image data. Aforesaid recording apparatus may be classified by the recording system into ink jet system, wire dot system, thermal system, laser beam system, etc.

The recording sheet used for recording apparatus may be, in addition to the ordinary sheet, a thick sheet such as postcard, envelope, etc. or special sheet such as thin plastic sheet. Recording sheet is fed by manual sheet feeding or fed automatically and continuously by automatic sheet feeding apparatus.

Said automatic sheet feeding apparatus may be a built-in type which is built into the recording apparatus, or external type which is mounted on the recording apparatus, and the present invention relates to the recording equipment on which the external automatic sheet feeding apparatus is mounted.

For the recording apparatus, a horizontal type apparatus is generally used and a sheet inserting hole and sheet discharge hole are provided on the upper surface of the apparatus, and it is so constructed that recording is executed while delivering the sheet along the recording sheet transporting route which is formed roughly in U-shape in the recording apparatus.

However, in the case of the conventional system wherein an automatic sheet feeding apparatus is mounted on the horizontal recording apparatus, the automatic sheet feeding apparatus is fixed on the upper surface of the said recording apparatus, so that the sheet is automatically fed at the aforesaid sheet inserting hole of the recording apparatus, and the automatic sheet feeding apparatus is fixed on the recording apparatus as the latter is horizontally set and therefore considerable space is necessary for its installation, thus presenting the problem of space efficiency.

Besides, the recording sheet transporting route is U-shaped and it is practically impossible to provide the transporting route linearly, thus presenting problems such as that when a recording sheet with rigidity such as postcard is printed, a smooth sheet delivery is impossible.

In the case of aforesaid conventional recording apparatus, recorded sheets are discharged upward from the sheet discharge port or hole and they are piled up on the stacker almost in upright posture and therefore the sheet being discharged (ascending) contacts the surface of the sheet which has just been recorded and the recorded sheet is apt to be stained.

Especially, in the case of the ink jet recording apparatus wherein recording is made by applying a liquid on the sheet, certain time is required for fixing the ink and besides such ink jet system is frequently used for color printing wherein printing is overlapped and consequently staining of the recorded surface becomes sometimes excessive.

In order to solve this problem, such counter-measures have been taken as reinforcing ink fixing action or reducing discharge speed but such measures require the use of a large apparatus and accompanies increase of cost, decrease of throughput, etc. and it was not a conclusive solution.

When an external automatic sheet feeding apparatus is mounted on the recording apparatus, a system to drive the sheet feeding roller utilizing the driving force of the recording sheet transporting system (driving force to drive sheet feeding roller) has been employed and at the joint of said two systems is the section where drive gear and driven gear mesh with each other.

However with the conventional construction, automatic sheet feeding apparatus is generally mounted on the recording apparatus, the flat sections formed by the two casings are brought in contact to clamp them, and therefore many parts exist at the relative position between the driving gear supported by the frame member of the recording apparatus main body (usually via a bearing member) and the driven gear axially supported at the automatic sheet feeding apparatus and due to the accumulation of error related to such system, it has been difficult to set the shaft to shaft distance with high precision.

Besides, since the casing part is brought in pressure-contact with the apparatus, a deflection may be produced at the casing during use due to vibration or other external force, thus the shaft to shaft distance of the gears varies and jumping of teeth of the gear occurs resulting in an inaccurate sheet feeding action.

Besides, with the conventional construction wherein an automatic sheet feeding apparatus is mounted on the horizontally set recording apparatus, the automatic sheet feeding apparatus is set at the upper surface and fixed at certain posture so that the sheet is fed automatically at the sheet inserting hole, and therefore it not only requires large installation space at the time of use but also the similarly large installation space even for storage of the apparatus, since the apparatus must be held in the same posture even during storage. Thus it presents the technical problem of low space efficiency.

SUMMARY OF THE INVENTION

The present invention has been made in the light of aforesaid conventional example and its objective is to provide the recording apparatus with excellent operability.

Another objective of the present invention is to provide a recording apparatus which can form a linear recording sheet delivery route wherein even a recording sheet with rigidity such as postcard can be smoothly delivered or conveyed.

Still another objective of the present invention is to provide a recording apparatus wherein staining of recording sheet is prevented by eliminating the friction contact with the recording sheet being discharged and the discharged recorded sheet is securely loaded on the tray.

Still another objective of the present invention is to provide a recording apparatus wherein the installation space of the recording device at the time of mounting of the automatic sheet feeding apparatus may be reduced, linear recording sheet passage and recording sheet transportation route is easily formed, in addition to the U-shaped transportation route for ordinary sheet and the recording sheet with rigidity can be easily delivered into the recording section. Another objective is to provide a recording apparatus which has a high operability and a stable posture at the time of use and can be made into an extremely compact vertical recording apparatus at the storage, thus reducing the space requirement at the time of use and at storage.

Still another objective of the present invention is to provide a recording apparatus wherein an automatic sheet feeding apparatus may be fixed on the back of the vertically set horizontal recording apparatus, and stability and operability of the apparatus are secured when an automatic sheet feeding apparatus is mounted and at storage, the apparatus can be made extremely compact reducing storage space and in addition, when automatic sheet feeding apparatus is mounted, manual sheet feeding can be done easily in addition to automatic sheet feeding.

The present invention which can achieve aforesaid objectives can reduce the installation space when the automatic sheet feeding apparatus is mounted by providing the recording apparatus which is so constructed that an almost linearly extending recording sheet transporting route is formed through the recording section as the apparatus is set vertically, and automatic sheet feeding apparatus can be fixed or mounted freely thereon so that the recording sheet is fed into the opening of the inlet of the said transporting route. Such recording apparatus also easily forms a linear recording sheet transporting route which can smoothly transport even rigid recording sheet such as postcard.

The horizontal recording apparatus which has a sheet inserting hole and a sheet discharge hole at the upper surface and forms a roughly U-shaped recording sheet transporting route is so constructed that sheet is automatically fed through the roughly linear recording sheet transporting route by installing a roughly linear recording sheet transporting route extending from the sheet inserting hole to the sheet discharge hole via the recording section, and an automatic sheet feeding apparatus for supplying recording sheet at the base as said recording apparatus being held in vertical position. With such construction, the installation space occupied by the automatic sheet feeding apparatus to be mounted can be reduced and besides a linear transporting route is easily formed in addition to the U-shaped transporting route and thus the effect that the ordinary sheet as well as the thick sheet such as postcard can also be smoothly transported is obtained.

By forming a manual sheet feeding passage which is connected to the roughly linear seconding sheet transporting route at the automatic sheet feeding apparatus, such effect that manual feeding of recording sheet can be made even when the automatic sheet feeding apparatus is mounted is obtained.

With the horizontal recording apparatus having sheet inserting hole and sheet carrying route at the upper surface, such construction has been employed that a recording sheet transporting route extending roughly linearly and roughly in up-down direction via the recording section is provided, and when the apparatus is used in vertical position, the recording sheet transporting route having its opening at the side inclines upward by 5°~25° toward the discharge direction. With such composition, it may be so arranged that the friction of recording sheet being discharged against the recording sheet on the sheet discharge tray is prevented or the former contacts the latter only after elapse of certain time and immediately before the completion of sheet discharge, so that staining of recorded surface is prevented and the discharged recorded sheet is loaded on the tray with certainty.

By mounting the automatic sheet feeding apparatus on the opening plane at the inlet of the said recording sheet transporting route and providing a sheet discharge tray at the outlet side of the said recording sheet transporting route, the same effect as stated above is obtained even when the automatic sheet feeding apparatus is mounted.

When the automatic sheet feeding apparatus is mounted and the recording apparatus is used in the state that it is inclined by certain angle, the resistance to the transportation of the recording sheet may be reduced by automatically feeding the sheet at a smaller angle against the recording sheet transporting route.

Further, with the recording apparatus having recording sheet transporting route formed roughly linearly through the recording section as the apparatus is in vertical position and an automatic sheet feeding apparatus is fixed or mounted freely at the plane on which the inlet of the transporting route exists, such composition is employed for the apparatus that the driving gear and driven gear for transmission of sheet feeding roller driving force are axially supported respectively at the main body of the recording apparatus and the automatic sheet feeding apparatus, a spring connecting means to assemble the main body of recording apparatus with the automatic sheet feeding apparatus in a pressure-contact state and a standard contact surface pressed against the automatic sheet feeding apparatus is provided on the frame member of the main body of recording apparatus which supports the driven gear at the point near the driving gear. Thereby a recording apparatus is obtained wherein at the mounting of the automatic sheet feeding apparatus to the recording apparatus, the shaft to shaft distance of the gear to transmit driving force can be accurately determined, the shaft to shaft distance is not affected by the vibration or external force at the time of the use of the apparatus and the connection which gives a stable sheet feeding action is obtained.

Further, with such composition that a rack section is provided or the frame which holds the driving gear of the said recording apparatus main body, a movable hook enforced by a spring is fixed to the said automatic sheet feeding apparatus and the rack section and the movable hook are engaged and thereby the automatic sheet feeding apparatus is mounted in pressure-contact state, the effect is obtained that at the mounting of the automatic sheet feeding apparatus on the recording apparatus, the automatic sheet feeding apparatus can be mounted accurately by simple operation.

Further, with such composition that three contacting planes including the standard contact surface are provided as the contact surfaces for connection of the recording apparatus and the automatic sheet feeding apparatus, the effect is obtained, in addition to the aforesaid effect, that at the mounting of the automatic sheet feeding apparatus on the recording apparatus, the position of the automatic sheet feeding apparatus can be precisely set.

Further, with the composition that an auxiliary hook and an auxiliary rack section which are engaged when certain external force works thereon are provided to the recording apparatus main body and the automatic sheet feeding apparatus, generation of local stress at the connecting part between the recording apparatus and the automatic sheet feeding apparatus is prevented, and thus stability and reliability and strength of the system is increased.

Further, such composition has been employed that automatic sheet feeding apparatus can be fixed or mounted freely on the back of the recording apparatus held in vertical posture, thus forming an assembly whose entire shape makes roughly a rectangular parallelepiped and in the storage the apparatus is held in an upright posture with a flat base and at use, it takes an inclined posture with its supports being opened. With such composition, a recording apparatus has been obtained wherein the installation space of recording apparatus with the automatic sheet feeding apparatus being mounted is saved, a linear recording sheet passage and recording sheet transportation route are easily formed, a recording apparatus with high operability is provided with stable posture upon use, an extremely compact vertical recording apparatus is formed upon storage, and the space required for storage is reduced.

With the composition that sheet discharge tray is formed by opening a rotatory cover axially supported at the front of the vertically set recording apparatus, the effect is obtained, in addition to aforesaid effect, that the sheet discharge tray is easily formed by utilizing the already installed cover.

Further, with the construction that the sheet feeding cassette of the automatic sheet feeding apparatus is rotatory fixed in the posture between perpendicular upon non-use to inclined upon use as against the sheet feed driving section, the effect is obtained, in addition to aforesaid effect, that the accommodation space upon storage is reduced and the sheet transporting load is reduced by employing the milder curvature for the sheet transporting route extending from the automatic sheet feeding apparatus to the recording apparatus.

Further, such composition has been employed that an automatic sheet feeding apparatus for delivering the recording sheet into the recording sheet transporting route is mounted on the back of the recording apparatus which forms a roughly flat recording sheet transporting route passing through the recording section held in vertical posture, a freely opening/closing movable member which constitutes the support when the apparatus is in use is provided at the lower part of the casing of the automatic sheet feeding apparatus and a roughly linear manual sheet supporting table which extends up to the recording sheet transporting route is formed by the movable member when the movable member opens. With such construction, it is possible to secure stability and operability of the apparatus upon use with the automatic sheet feeding apparatus duly mounted and the effect is obtained that the accommodating space is saved by making the apparatus compact upon storage and when the automatic sheet feeding apparatus is mounted, a manual sheet feeding is also made possible in addition to the automatic sheet feeding.

With the recording apparatus constructed in such a way that the automatic sheet feeding apparatus can be fixed or mounted freely on the back thereof as it is set in vertical posture, such construction has been employed that the lower part of the casing of the automatic sheet feeding apparatus is formed by the movable member which is rotatable in the direction to open the lower end and at the time of use, the movable member extends forwards to form the support of the recording apparatus. With such construction a recording apparatus is obtained wherein the entire shape is made compact, stability of the apparatus is secured when it is used by mounting an automatic sheet feeding apparatus, and at storage the apparatus can be made compact and accommodating space can be substantially reduced.

DESCRIPTION OF THE PREFERRED EMBODIMENT

Figure 3:
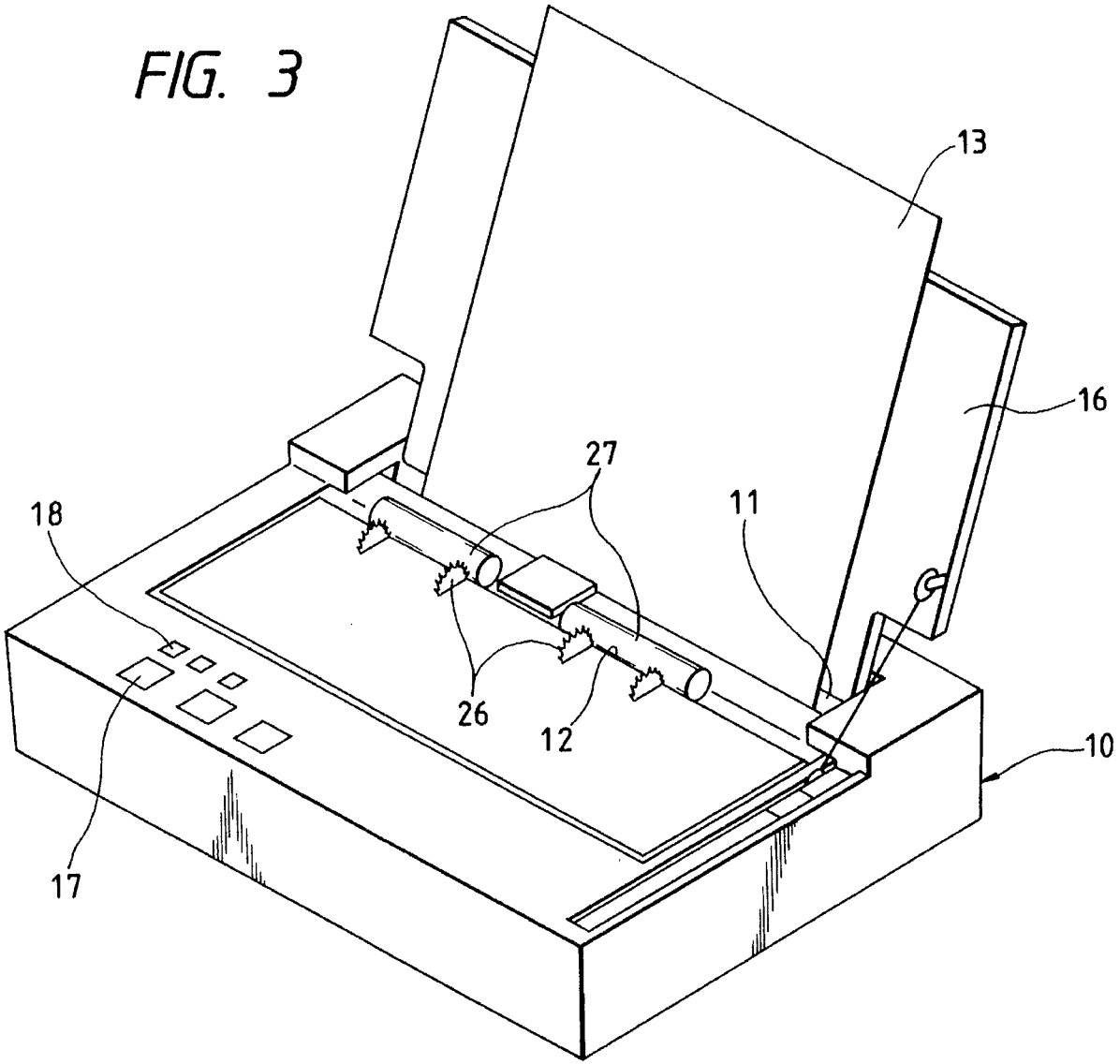
FIG. 3 is the typical diagonal view to show the state of use of the main body of the recording apparatus of FIG. 1 installed horizontally.
Figure 4:
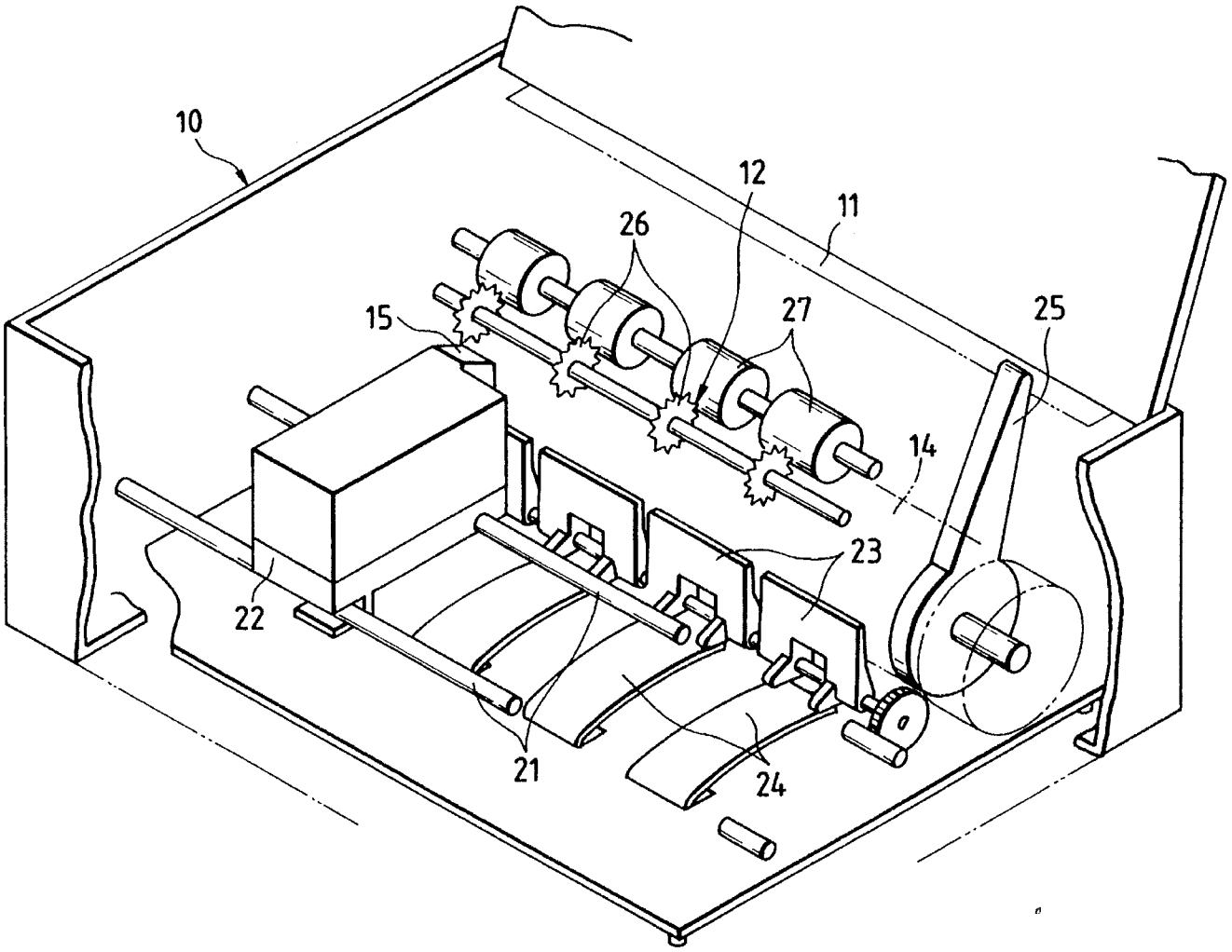
FIG. 4 is a partial broken-out diagonal view to show the typical rough construction inside the recording apparatus.

FIG. 3 is the diagonal view to show the state of use of the horizontal recording apparatus (main body) 10 which is a preferred embodiment of the present invention and FIG. 4 is the diagonal view to show the rough construction of the inside of the recording apparatus of FIG. 3.

In FIGS. 3 and 4, a sheet inserting hole 11 and sheet discharge hole 12 are provided at the upper surface of the recording apparatus 10 (for example, a recording apparatus to employ bubble jet recording method wherein the image is formed by the recording liquid which forms drops of recording liquid utilizing thermal energy). Recording sheet 13 inserted through the sheet inserting hole 11 tightly contacts the circumferential surface of platen roller 14 which works concurrently as the sheet feeding roll, the sheet being delivered in the direction of arrow along the recording sheet transporting route formed roughly in letter U shape (FIGS.

1 and 2) and recorded as it passes through the recording unit which faces the recording head 15 and discharged upward through the recorded sheet discharge hole 12.

Figure 2:
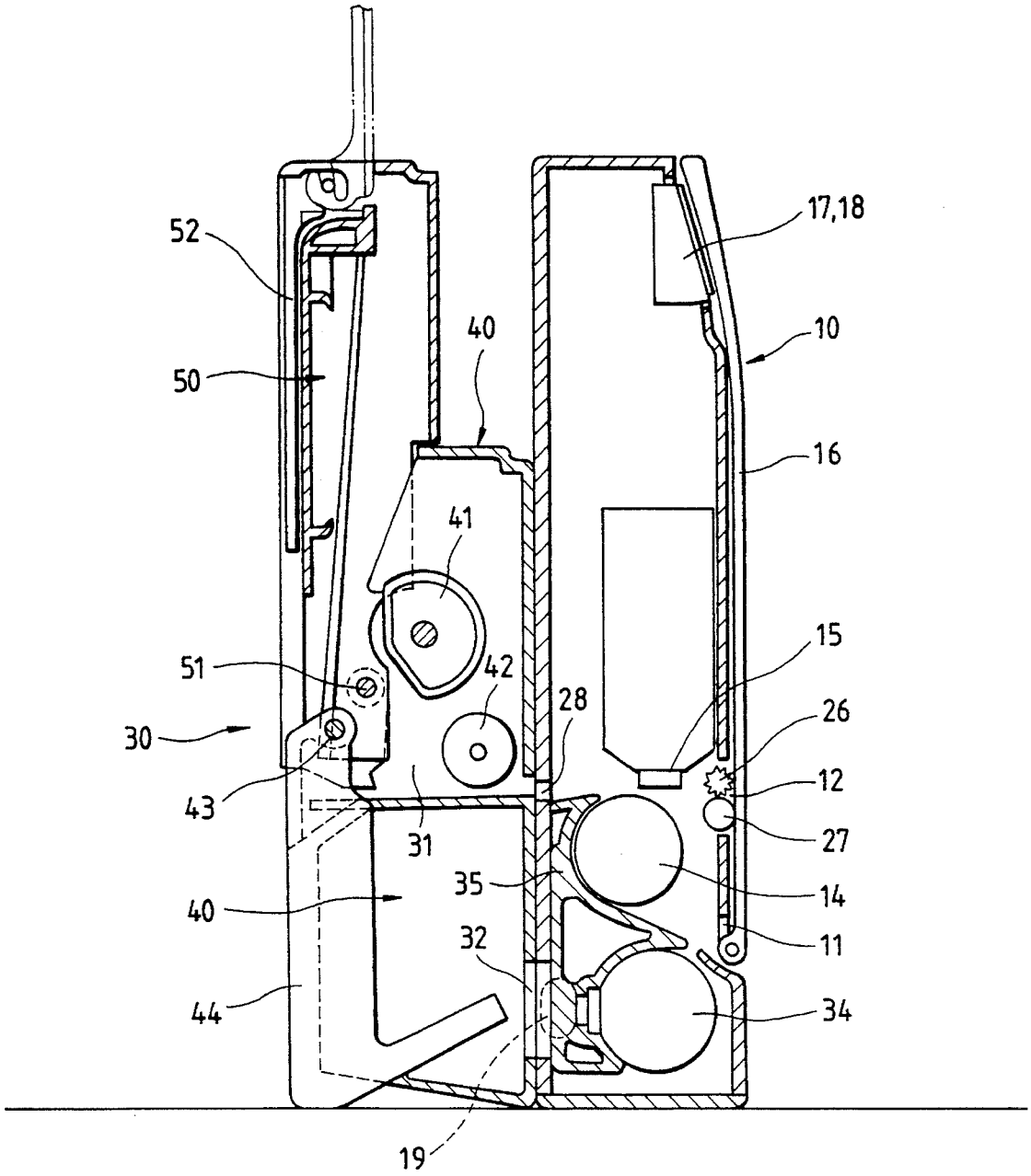
FIG. 2 is the typical longitudinal section drawing to show the state of the recording apparatus of FIG. 1 in storage.

Here, the sheet feed tray 16 is axially fitted at the upper plane of recording apparatus 10 in such manner that it can open and close and when in use (at recording) it opens to function as the sheet feeding tray and when it is not in use, it is set at the closed position as shown in FIG. 2 and functions as the cover 16 to protect and cover the upper surface of the recording apparatus 10 where the sheet inserting hole 11, sheet discharge hole 12, switches 17, indicator 18 etc. are arranged.

In FIG. 4, recording head 15 is mounted on the carriage 22 which makes reciprocal movement along the guide axis 21 and 21 that are parallel to the platen roller 14. The recording head 15 shown in the Figure illustrates the case of ink jet head which is made into one unit with the ink tank.

At the upper stream in the carrying direction of the recording head 15 is the sheet holding plate 23 which presses the sheet against the platen roller 14. This sheet holder 23 is pressed against the circumferential plane of platen roller 14 by plate spring 24.

The pressing force of the said sheet holding plate 23 can be released by controlling the lever 25 which is axially supported by the axis of platen roller 14. At the position of sheet discharge hole 12 are the wheel 26 and roller 27 which assist the discharge of recording sheet 13.

Figure 5:
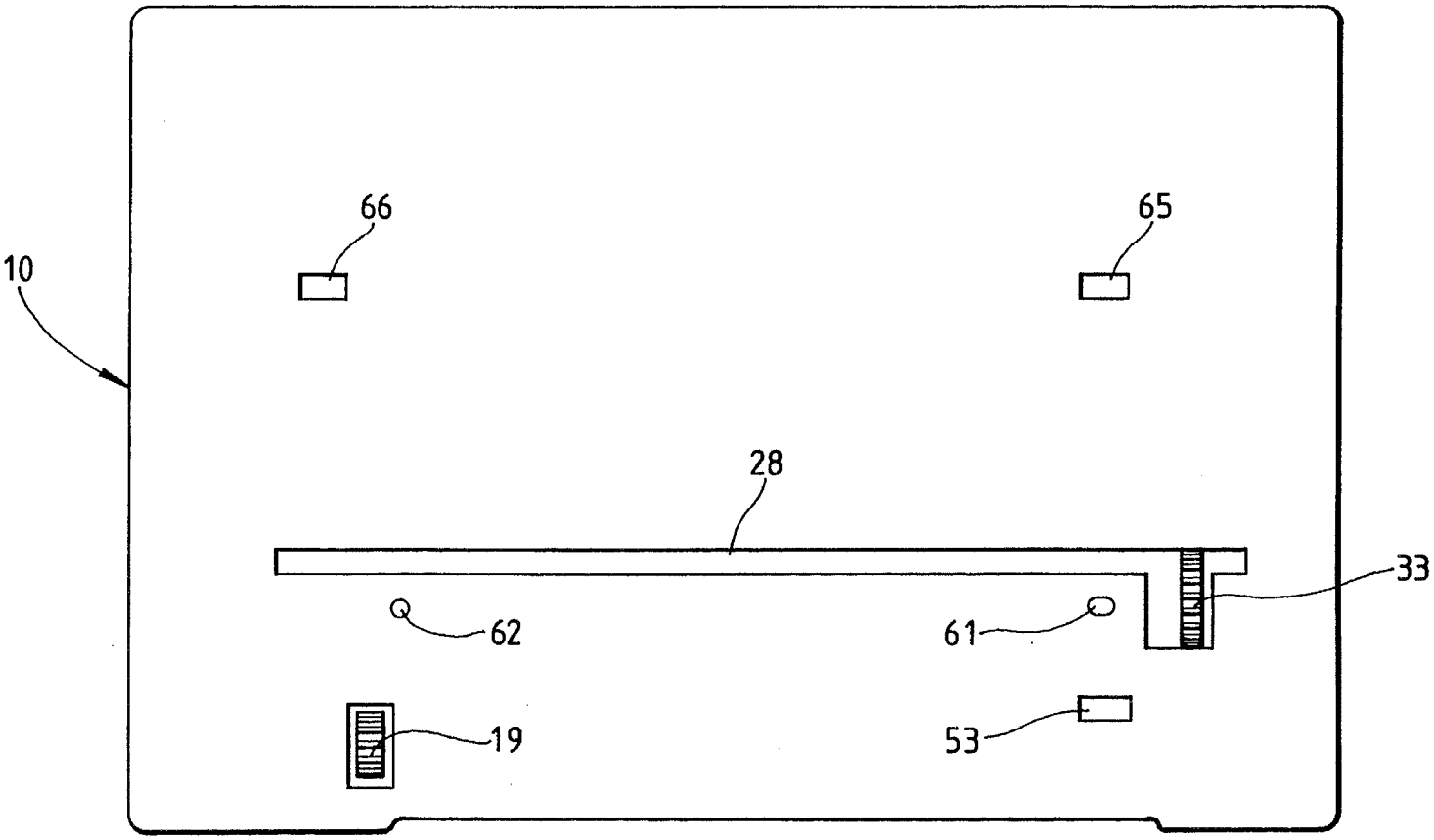
FIG. 5 is the typical base drawing to show the base of the recording apparatus of FIG. 3.

FIG. 5 is the drawing to indicate the base of the recording apparatus (main body) 10 (it becomes the back when the apparatus takes vertical posture as stated later).

At the base of recording apparatus 10 is formed the second sheet inserting hole 28 which is so constructed that the roughly linear second recording sheet carrying route extends roughly in up-down direction from the said inserting hole 28 up to the said sheet discharge hole 12 through the recording section located in between the recording head 15 and platen roller 14. This second recording sheet carrying route is usable when the recording apparatus 10 is installed in vertical position as stated later (FIGS. 1 and 2) and since it is not bent, it provides such advantage that the thick sheet such as postcard or envelope or the recording sheet with rigidity such as the plastic sheet and other special sheet can be easily deliver.

The aforesaid recording apparatus 10 can be used in the vertical posture and when it takes the vertical position, the automatic sheet feeding apparatus can be freely fixed or unfixed and the sheet may be fed automatically through the sheet inserting hole 28 at the back (in the vertical position).

Figure 1:
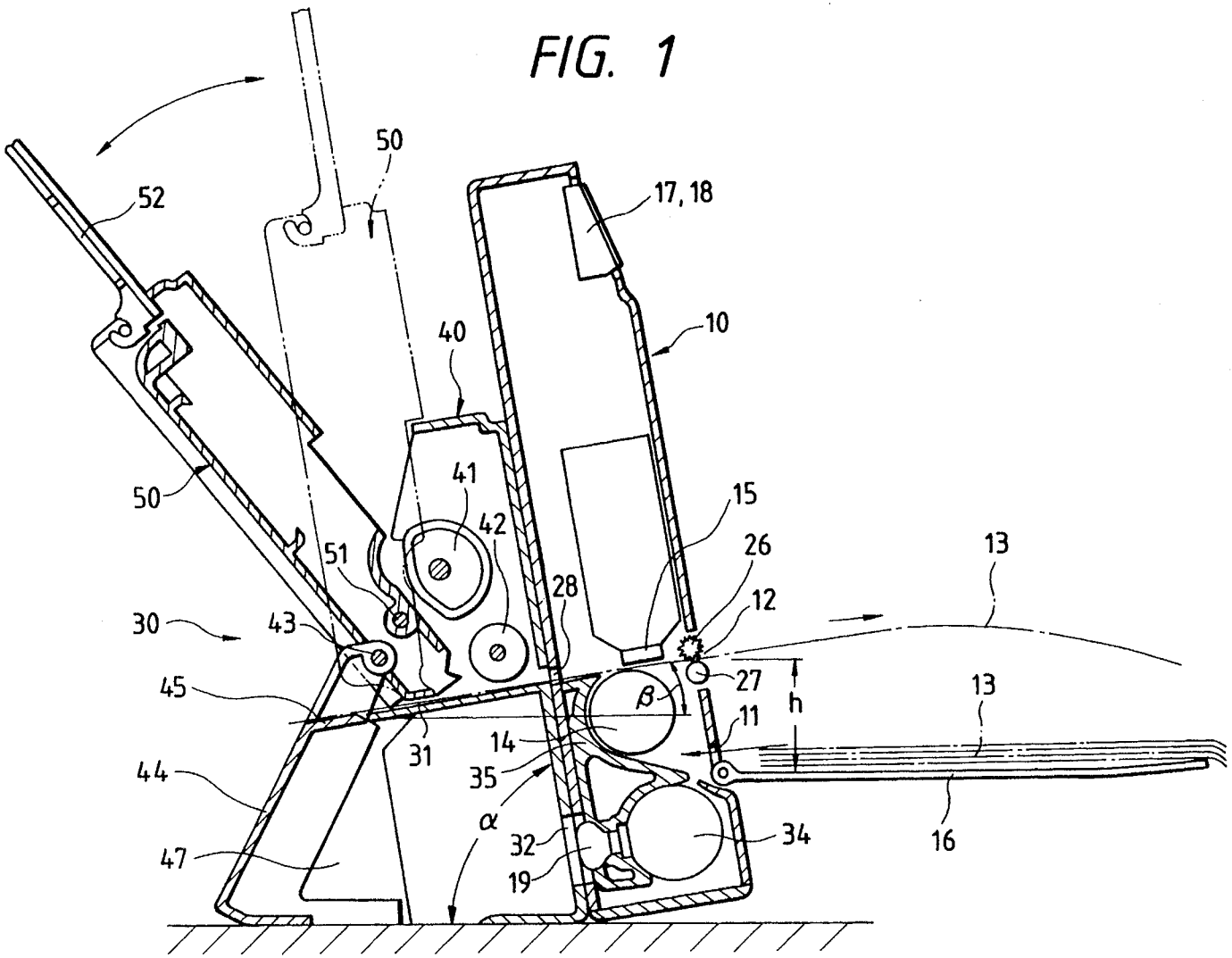
FIG. 1 is the typical drawing to show the longitudinal section in use of the recording apparatus equipped with the automatic sheet feeding apparatus embodying the present invention.

FIG. 1 and FIG. 2 are the longitudinal sectional drawings of the state where the automatic sheet feeding apparatus 30 is fixed to the back of the recording apparatus installed in vertical position, wherein FIG. 1 shows the state in use (upon recording) and FIG. 2 shows the state in storage.

In FIGS. 1 and 2, when the recording apparatus 10 is installed in vertical position, a roughly linear recording sheet carrying route passing through the recording section (in between the recording head 15 and platen roller 14), that is, the carrying route from the second sheet inserting hole 28 up to the sheet discharge hole 12 is formed.

Here, the automatic sheet feeding apparatus 30 is set at such position that it feeds the recording sheet 13 to the said linear carrying route from the inlet (sheet inserting hole) 28 and it is fixed to the back side (the side at which the inlet 28 opens) of the recording apparatus 10 in the way that it can be freely fixed and unfixed. The automatic sheet feeding apparatus is also equipped with the linear sheet passage 31 for feeding recording sheet which is connected roughly linearly to the said almost linear recording sheet carrying route, apart from the automatic sheet feeding mechanism to be stated later.

This sheet passage 31 is a sheet insertion guide passage to feed the recording sheet manually and it is closed in the mode where automatic sheet feeding is possible as shown by the solid line in FIG. 1 and it is opened in the mode of sheet set shown by 2-dot chain line where automatic sheet feeding is impossible so that manual insertion becomes possible.

Automatic sheet feeding apparatus 30 is composed of the sheet feed driving unit 40 which is connected to the recording apparatus 10 in fixed state and sheet feeding cassette 50 rotatory fixed with the posture from roughly perpendicular to inclined as against the said sheet feed driving unit 40.

Figure 6:
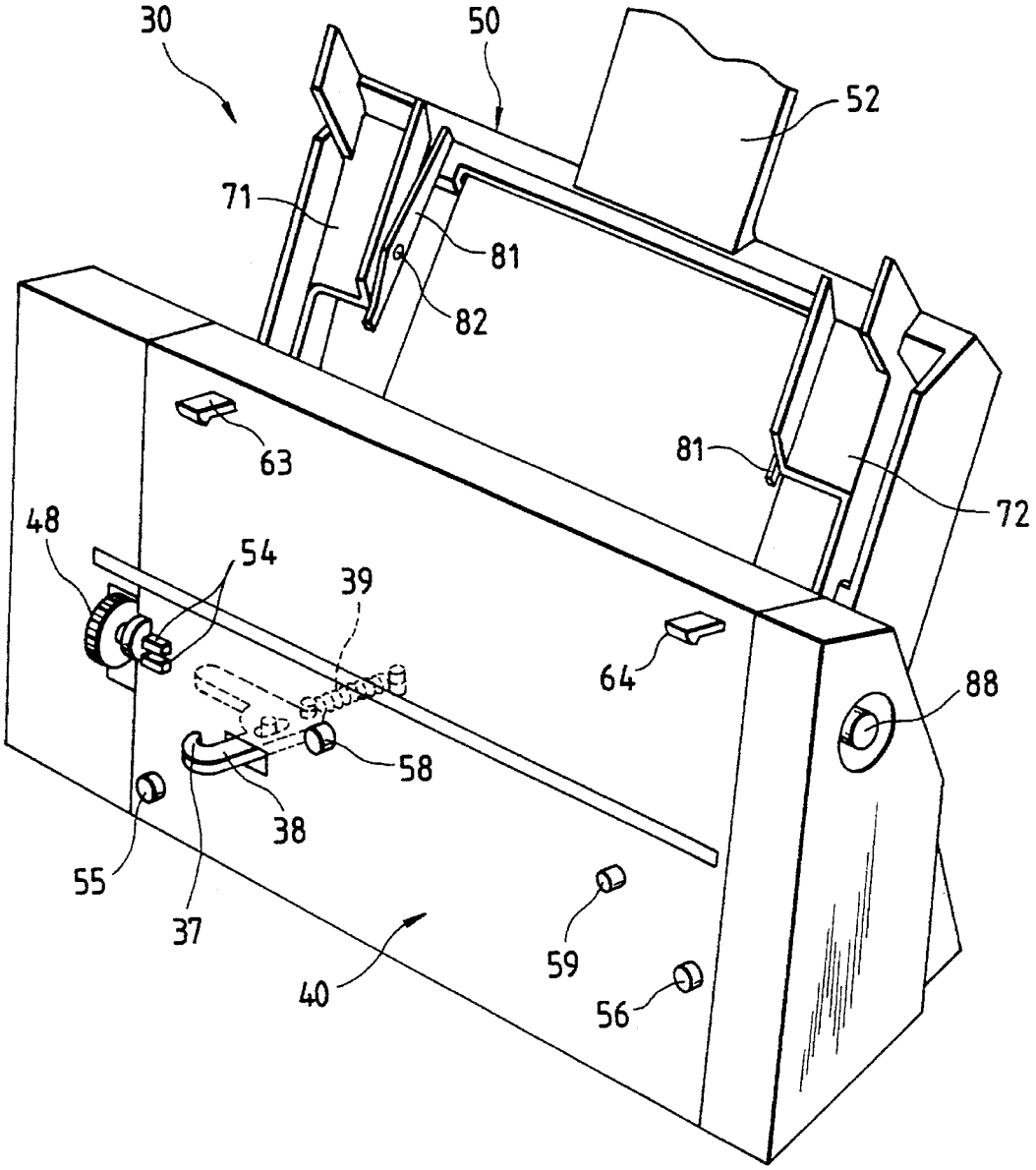
FIG. 6 is the typical diagonal view of the automatic sheet feeding apparatus of FIG. 1 viewed from the fitting plane side.

FIG. 6 is a diagonal view of the automatic sheet feeding apparatus 30 in the state of FIG. 1 as viewed from the plane connected to the recording apparatus 10.

The said sheet feeding cassette 50 stores the recording sheet 13 at the set position and the said sheet feed driving unit 40 delivers the stored recorded sheet 13 one by one to the recording apparatus 10.

In FIGS. 1, 2 and 6, the sheet feeding cassette 50 is axially and rotatory (being able to open and close) around fulcrum 51 at the position facing the upper half of sheet feed driving unit 40. At the point of sheet feed driving unit 40 where it faces the sheet feeding cassette 50 are fixed a sheet feeding roller 41 and auxiliary feeding roller 42.

A foldable sheet feeding tray 52 is fixed to the sheet feeding cassette 50 and at the time of use, it is drawn out to form a tray as shown in FIG. 1 and at the time of storage, it can be folded into the cassette unit 50 as shown in FIG. 2.

A section of the lower part of the casing of sheet feed driving unit is composed of the movable member 44 which is rotatory (or being able to open and close) fixed around the fulcrum 43 and the said movable member 44 is opened at the time of use forming the support. Said movable member 44 is closed at the time of storage as shown in FIG. 2.

An opening 32 is formed at the wall facing the recording apparatus 10 of the movable member 44 which forms the open-close support.

On the other hand, change-over switches 19 such as AC/DC change-over switch which is operated at the said back surface (or the base when installed horizontally) is provided at the lower part of the back of the recording apparatus 10. The opening 32 is provided at the position corresponding to the switches 19 so that the switches can be operated through such opening 32 even when automatic sheet feeding apparatus 30 is mounted.

Thus, the operator cannot control the change-over switches 19 when the movable member 44 (open-close support) is closed (FIG. 2) because the support is closed thereby but when said movable member 44 is in the open state (FIG. 1), the open section 47 is formed at the support as shown in the Figure and the change-over switches can be operated.

Said movable member 44 is provided with the shelf which forms the table 45 for supporting the sheet when the movable member 44 opens at the inlet of the said sheet passage 31 for manual sheet insertion. Said table formed by the shelf 45 utilizes the movable member 44 and it complements the roughly linear sheet passage 31 which extends to the linear recording sheet transporting route of recording apparatus 10, so that the recording sheet 13 is easily and correctly inserted.

Recording apparatus 10 installed vertically and provided with the automatic sheet feeding apparatus 30 is brought into the storage conditions by folding the said cover (sheet discharge tray) 16 as shown in FIG. 2, holding the sheet feeding cassette in perpendicular position and closing the movable member (support) 44. At such storage conditions, the profile of the apparatus takes roughly the profile of rectangular parallelopiped with flat bottom and it is folded into a compact upright posture without projections.

In the state of use as shown in FIG. 1, the cover 16 is unfolded to form the sheet discharge tray and movable member (support) 44 is opened to bring the apparatus in a stable posture inclined by preset angle α (for example, 5°~25°) as shown in the Figure. The lower casing of sheet feed driving unit 40 is so constructed that it forms a flat bottom inclined by the preset angle when movable member 44 is opened as shown in the Figure.

Recording sheet 13 is set in the sheet feeding cassette 50 as it is in closed state (perpendicular position).

After preparing the apparatus in the state to enable recording, the recording action is started by opening (inclining) the sheet feeding cassette 50 as shown by the solid line in the case of recording by automatic sheet feeding.

When recording is conducted by manual sheet feeding, the sheet feeding cassette 50 is held in perpendicular (closed) position and the recording sheet 13 is fed to the recording apparatus 10 through table 45 and sheet passage 31.

Here, as shown in FIG. 1, when the apparatus is used, as the movable member 44 is kept open, the linear recording sheet transporting route of recording apparatus 10 and the sheet passage 31 (including table 45) at the side of automatic sheet feeding apparatus are inclined upward in the direction of sheet discharge by the preset angle β (5°~25°).

At the side outlet (sheet discharge hole) 12 of recording sheet transporting route of recording apparatus 10 is provided a sheet discharge tray which is formed by unfolding the said cover 16. This sheet discharge tray 16 is so fixed that it extends roughly in horizontal direction at the position lower than the sheet discharge hole 12 by preset elevation h, as shown in the Figure.

When the sheet discharge tray 16 is so arranged, it is possible to discharge the recording sheet 13 without bringing it in contact with the recording sheet 13 on the sheet discharge tray 16 and consequently it is possible to prevent contamination of ink due to contact with unfixed recording ink, particularly in the case of ink jet recording apparatus etc. where recording is conducted by applying liquid ink.

Next the structure of connection of recording apparatus 10 and automatic sheet feeding apparatus 30 is explained.

Figure 7:
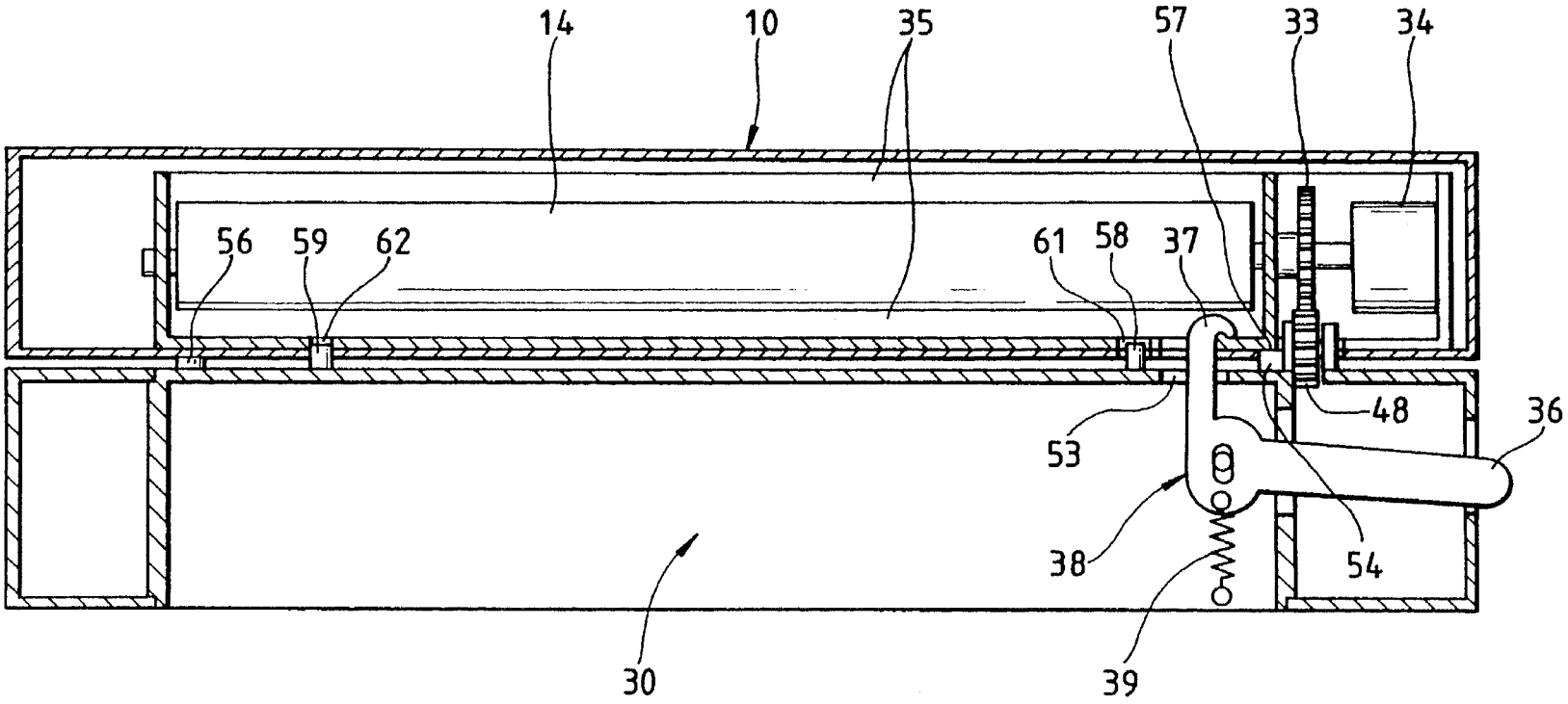
FIG. 7 is the sectional drawing of key part to show the state of locking of the connecting part between the main body of the recording apparatus and the automatic sheet feeding apparatus.
Figure 8:
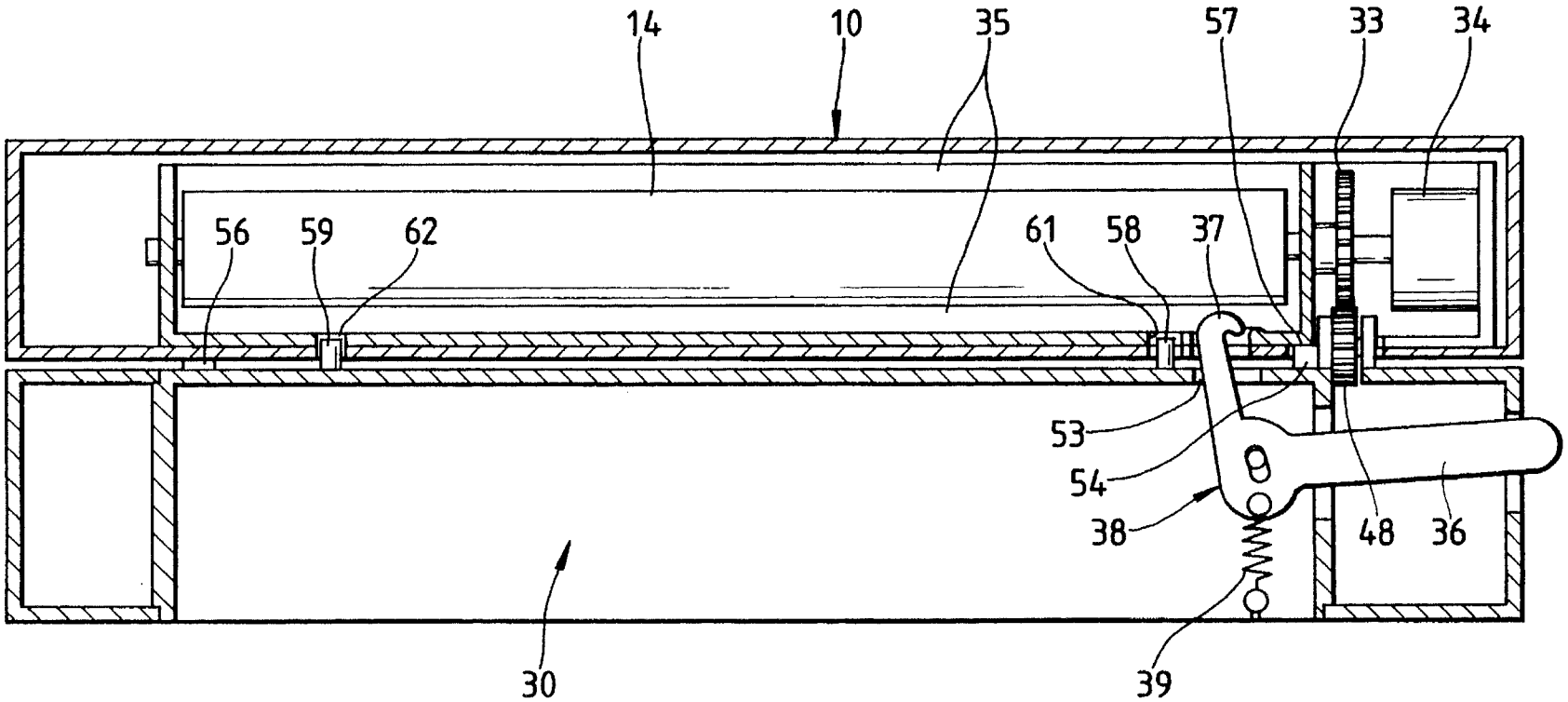
FIG. 8 is the sectional drawing of key part to show the state of unlocking of the connecting part shown in FIG. 7.

FIG. 7 is the horizontal sectional view to show the state of connection between the recording apparatus 10 and automatic sheet feeding apparatus 30, and FIG. 8 is the state where lock is released after the state of FIG. 7.

First, at the back of the recording apparatus 10 is axially supported the driving gear 33 which rotates synchronously with the platen roller 14 as shown in FIGS. 5, 7 and 8, and on the other hand, at the side where automatic sheet feeding apparatus 30 is mounted, the driven gear 48 which can transmit the rotary force to the sheet feeding roller 41 is axially supported.

At the time of connection, these gears 33 and 48 are geared in to transmit the driving force of sheet feeding roller 41 to the automatic sheet feeding apparatus.

At the inside of the recording apparatus 10 exists a frame member 35 which supports the platen roller 14 and bearing units of sheet carrying motor 34 etc. and the casing is fixed to the said frame member 35. Lever 36 and hook member 38 having front end hook 37 are fixed to the automatic sheet feeding apparatus 30 in the way to enable swinging and moving to and for preset distance and the hook member 38 is pushed toward inside by the tension spring 39.

An opening 53 into which the said hook 37 enters via the opening of the casing is formed at the position corresponding to the said hook 37 of the said frame member 35 of the recording apparatus 12 and hook 37 is engaged with the periphery of the opening 53. As shown in FIG. 7 and FIG. 8, at the periphery of the said opening 53 is formed the beading section so that the engagement of the said hook 37 should be smoothly made.

In the state where the hook 37 is engaged as shown in FIG. 7, the tension spring 39 extends (for example by 1~2 mm) and by its spring force, automatic sheet feeding apparatus 30 is pressed against the recording apparatus 10 and connected thereto.

The locking of the hook member 38 is released when the lever 36 is picked up and rotated as shown in FIG. 8 and automatic sheet feeding apparatus can be disengaged from the recording apparatus 10. Contact pressure under such state of connection is born by the contact surface at three places.

As shown in FIGS. 5 through 7, at the side of automatic sheet feeding apparatus 30 are formed the 1st contact surface 54 which constitutes the standard contact surface and 2nd and 3rd contact surfaces 55 and 56. The standard contact surface 54 is provided at the place near the driven gear 48 as shown in the Figure. The standard contact surface 57 which is the opposite surface of the standard contact surface 54 is formed at the frame member 35 having a high strength and rigidity and it is set at the position near the gearing point of gears 33 and 48.

The working line of the hook member 38 which provides the pressure of contact to the connecting part is located at the place where it provides a stable connection taking into account the position of three contact planes 54, 55 and 56. The second and third contact planes 55 and 56 may be made to contact directly to the back of the recording apparatus 10.

Position setting pins 58 and 59 are formed at the mounting place of automatic sheet feeding apparatus and by engaging these pins 58 and 59 with the position setting holes 61 and 62 formed at the back of the recording apparatus 10, the position of automatic sheet feeding apparatus 30 is set relative to the recording apparatus 10. Out of the two position setting holes 61 and 62, the hole 61 is an oblong hole as shown in FIG. 5.

Further, at the mounting plane of automatic sheet feeding apparatus 30 and recording apparatus 10 are provided the auxiliary hooks 63 and 64 and auxiliary racks 65 and 66 (FIG. 5) which are connected (engaged) when deflection occurs due to an external force loaded on the main body of the recording apparatus 10 and automatic sheet feeding apparatus 30.

Figure 9:
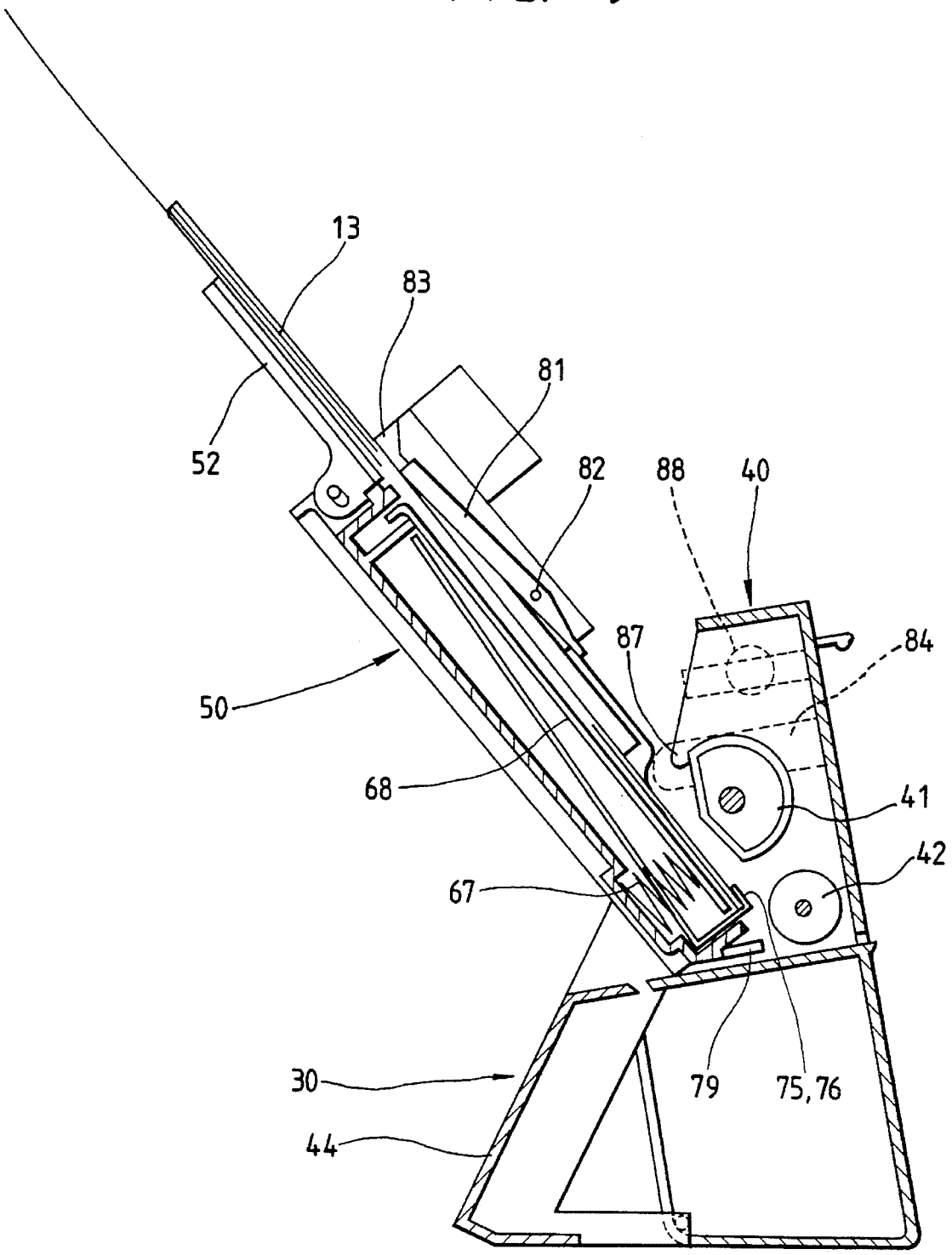
FIG. 9 is the typical longitudinal sectional drawing of the state of sheet feeding of automatic sheet feeding apparatus.
Figure 10:
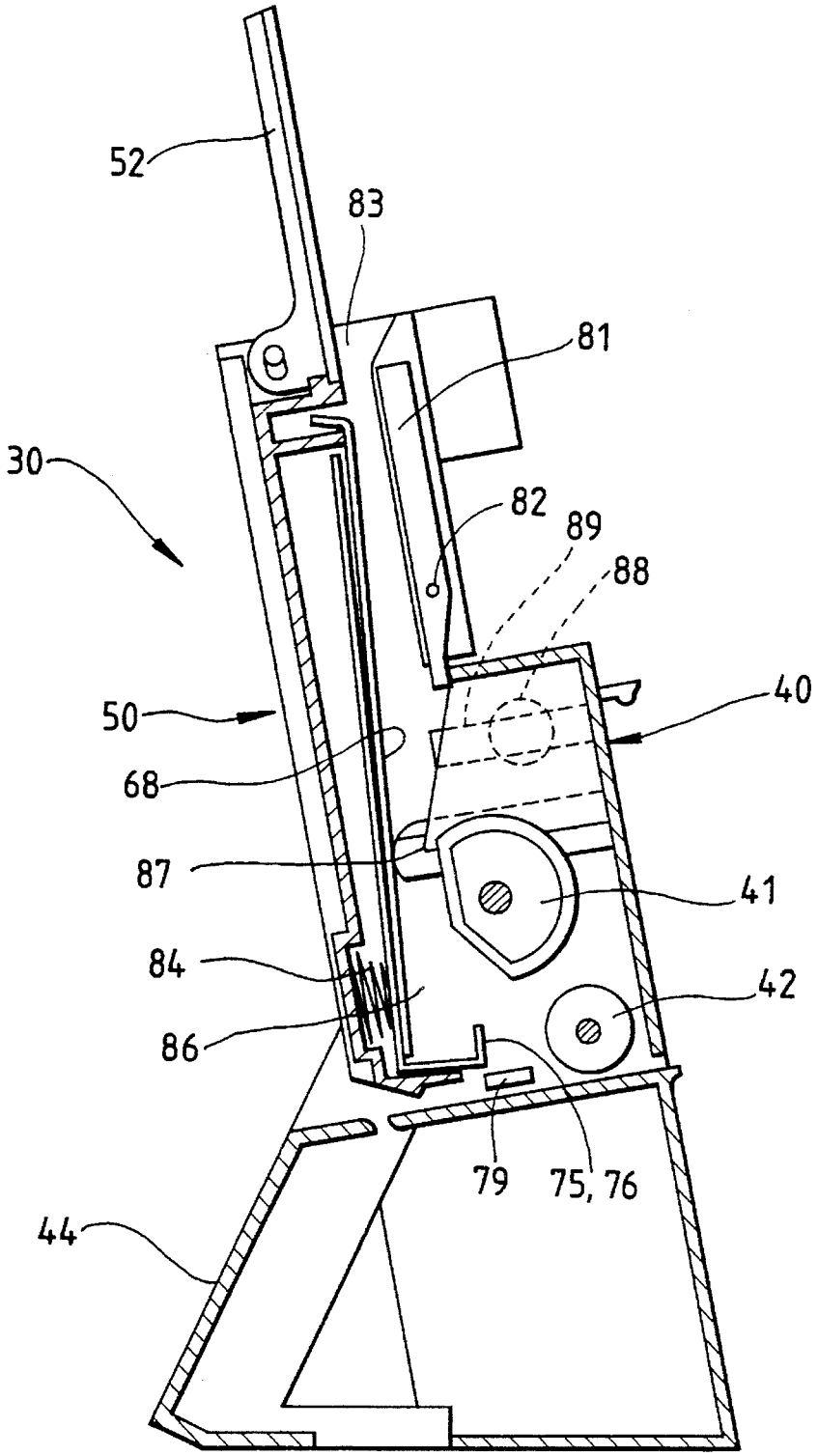
FIG. 10 is the typical longitudinal sectional drawing to show the state of sheet setting of automatic sheet feeding apparatus of FIG. 9.

FIG. 9 is the longitudinal sectional drawing of automatic sheet feeding apparatus 30 in the sheet feeding (inclined) state, while FIG. 10 is the longitudinal sectional drawing of the automatic sheet feeding apparatus 30 in the sheet set (perpendicular) state. In the two drawings, sheet feeding cassette 50 is provided with the pressure plate 68 which is pressed against the sheet feeding roller 41 by pressure plate spring 67. Sliders 71 and 72 (FIG. 11) whose width direction space can be adjusted according to the width of recording sheet 13 is guided and supported by the sheet feeding cassette 50.

Figure 11:
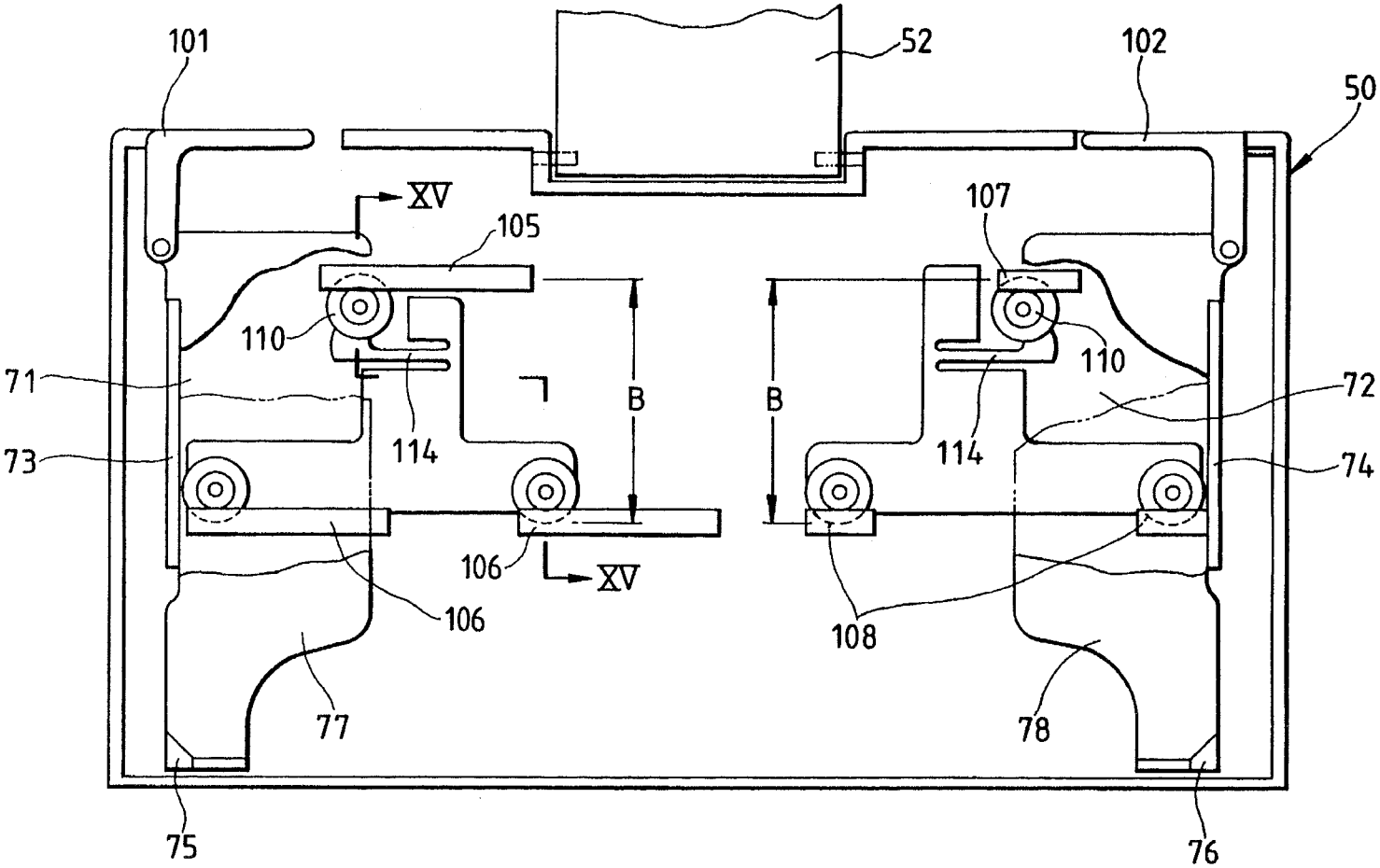
FIG. 11 is a partially omitted front view of the sheet feeding cassette of automatic sheet feeding apparatus of FIG. 9.
Figure 12:
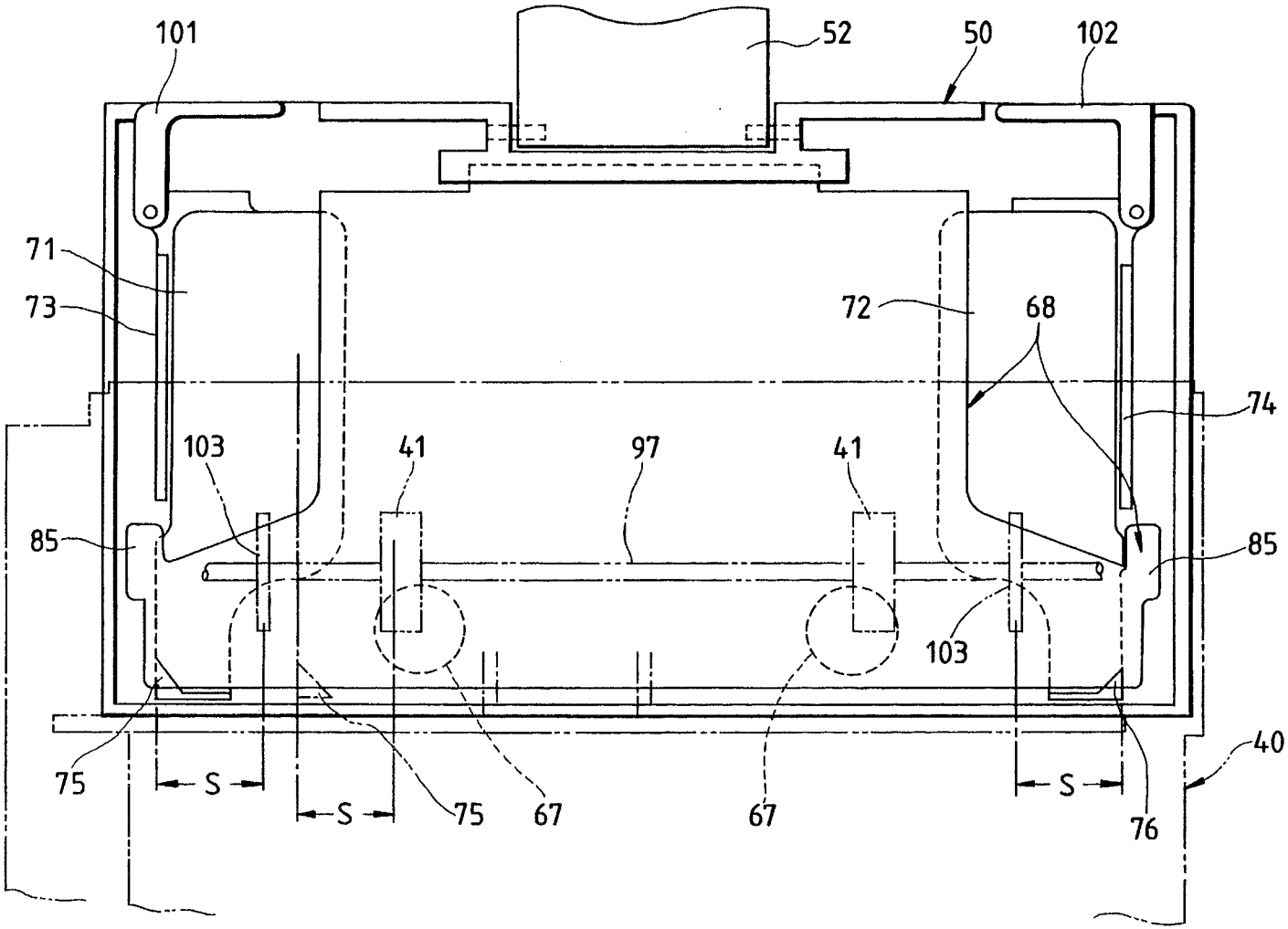
FIG. 12 is the front view of the sheet feeding cassette of automatic sheet feeding apparatus of FIG. 9.

FIG. 11 is the partial broken-out front view of sheet feeding cassette 50 which shows the sliders 71 and 72, while FIG. 12 is the partial broken-out front view of sheet feeding cassette 50 which indicates the pressure plate 68 in addition to the sliders 71 and 72.

Each slider 71 and 72 is provided with the side guides 73, 74 which contact the edges at two sides of the loaded recording sheet 13 and the law members 77, 78 having separation claws 75, 76 which hold from above two corners at the front end the loaded recording sheet 13, the spaces of such members being adjustable just like the sliders 71 and 72.

As shown in FIG. 9, the stored recorded sheet 13 is maintained in between the pressure plate 68 and the separation claws 75 and 76 at sheet feeding time, a semi-circular sheet feeding roller 41 rotates and contacts the recording sheet 13 to produce delivery force and while it is rotating one round, the top most one sheet is separated and fed up to the engagement point in the recording apparatus 10 via the auxiliary roller 42.

Figure 13:
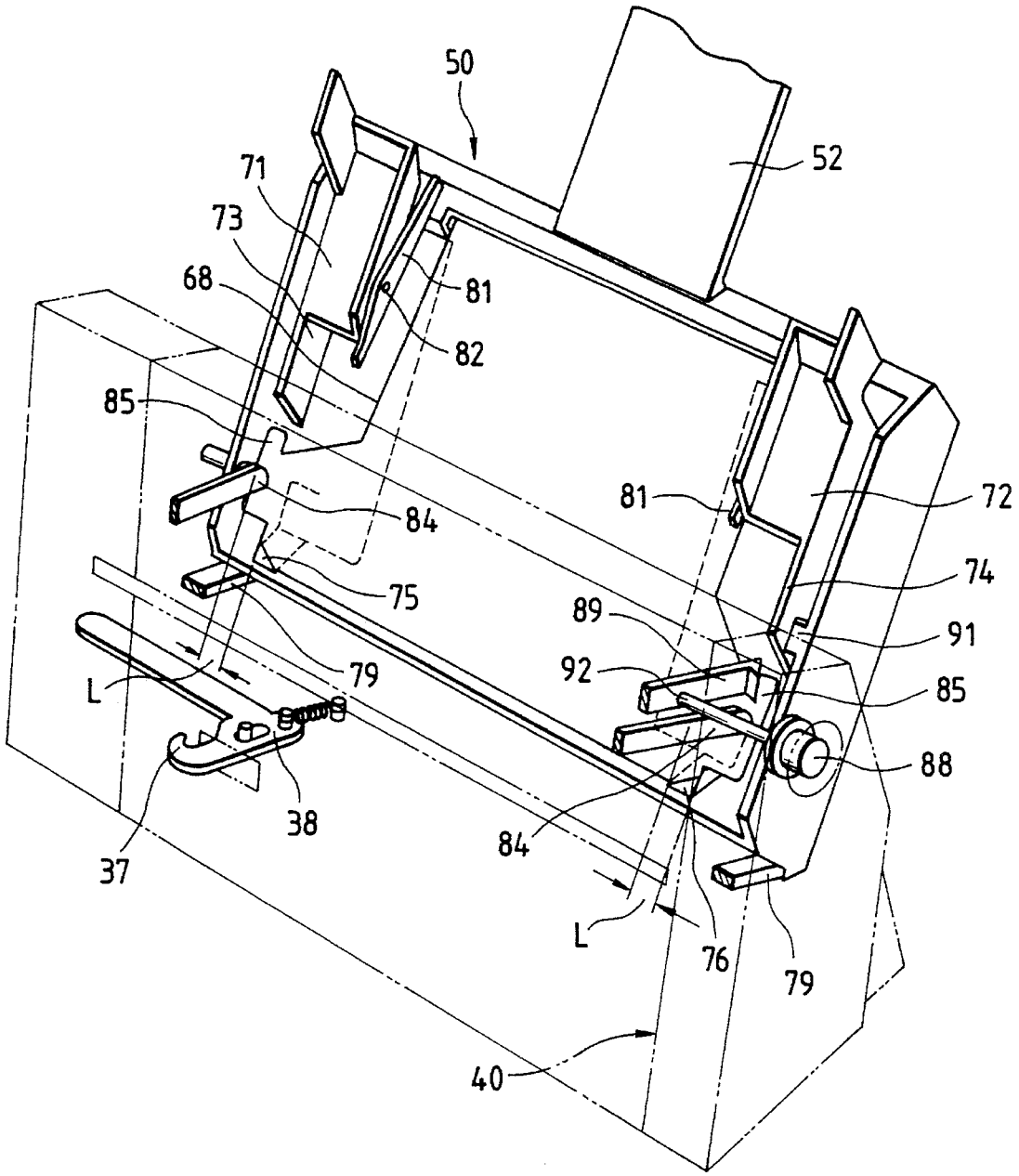
FIG. 13 is a partially omitted diagonal view to show typically the action mechanism between the sheet feed driving unit and sheet feeding cassette of the automatic sheet feeding apparatus.

FIG. 13 is a structural drawing to indicate various engaging members which function when the sheet feeding cassette 50 is changed over to the perpendicular sheet set position or inclined sheet feeding position.

In FIGS. 9 and 13, stoppers 79, 79 which contact the lower part of sheet feeding cassette 50 and hold the said cassette in inclined position (sheet feeding position) are formed at both sides of the casing of sheet feed driving unit 40.

The sliders 71 and 72 at both sides are provided with the sheet entry preventing means (sheet entry preventing lever) 81, 81 for preventing the insertion (mounting) of recording sheet 13 when the apparatus is in sheet feeding mode. These levers 81, 81 are axially supported at the sliders 71 and 72 by pins 82, 82 in the freely rotating state and as shown in FIG. 9, they rotate by their own weight in the sheet feeding mode and their upper ends contact the upper plane of the loaded sheet 13 at the point near the sheet inlet 83. Therefore, even when an operator should try to insert the recording sheet 13, the front end of the sheet is blocked by the front end of the sheet entry prevention levers 81, 81 and it can not enter into the cassette.

When the sheet feeding cassette 50 is turned to the perpendicular sheet set position, the lower ends of the sheet entry prevention levers 81, 81 hit the edge of the casing at the side of the sheet feed driving unit 40 as shown in FIG. 10, and the levers 81, 81 turn anticlockwise for preset amount and their upper ends are lifted to open the sheet inlet 83 as shown by the Figure. Thus, the recording sheet 13 can be inserted into the cassette through the sheet inlet 83.

As shown in FIGS. 10 and 13, pressure plate pushing members 84, 84 which project toward the cassette 50 are provided at both sides of the casing of sheet feed driving unit 40 and when the sheet feeding cassette 50 is turned to roughly perpendicular sheet set position, the pressure plate pushing members 84, 84 contact the lugs 85, 85 (FIG. 12) formed at both sides of the pressure plate 68 and thereby the pressrue plate 68 is pushed down. Thus, the space between the sheet feeding roller 41 and pressure plate 68 is widened, sheet insertion space 86 is formed for recording sheet 13 and the system becomes ready for setting the recording sheet 13, as shown in FIG. 10.

Under such status, the separation claws 75, 76 are held at the level equal to the sheet feeding roller 41 (which is positioned at the retreating angle) or somewhat overlapping therewith as shown in FIG. 10 and a guiding projection 87 with the height somewhat projecting above the sheet feeding roller 41 toward the cassette side is formed at the inlet side of the sheet feeding roller 41 of the casing of the sheet feed driving unit 40. Thus the recording sheet 13 to be inserted is securely set in between the separation claws 75, 76 and the pressure plate 68.

The contacting position at the time when the pressure plate 68 is pushed down (the position of pressure plate pushing members 84, 84) is the position wider than the maximum moving range of separation claws 75, 76 toward both sides by the distance L and it is outside of the width of the recording sheet 13 having maximum width.

Sheet feeding cassette 50 is maintained at the sheet set stage (perpendicular position) by locking mechanism which can be released by button 88 (FIGS. 10 and 13). This locking mechanism is composed of the hook lever 89 projecting at the end of the casing of the sheet feed driving unit 40 and the hooking part 91 formed at the edge of the sheet feeding cassette 50 and the lock is engaged when it is turned to the sheet setting state to hook the aforesaid members. The locking mechanisms 89, 91 are released when the button 88 is depressed, hook lever 89 is deformed by elasticity by the edge 92 (FIG. 13) of the button 88, thus disengaging the lever from the hooking part 91.

Figure 14:
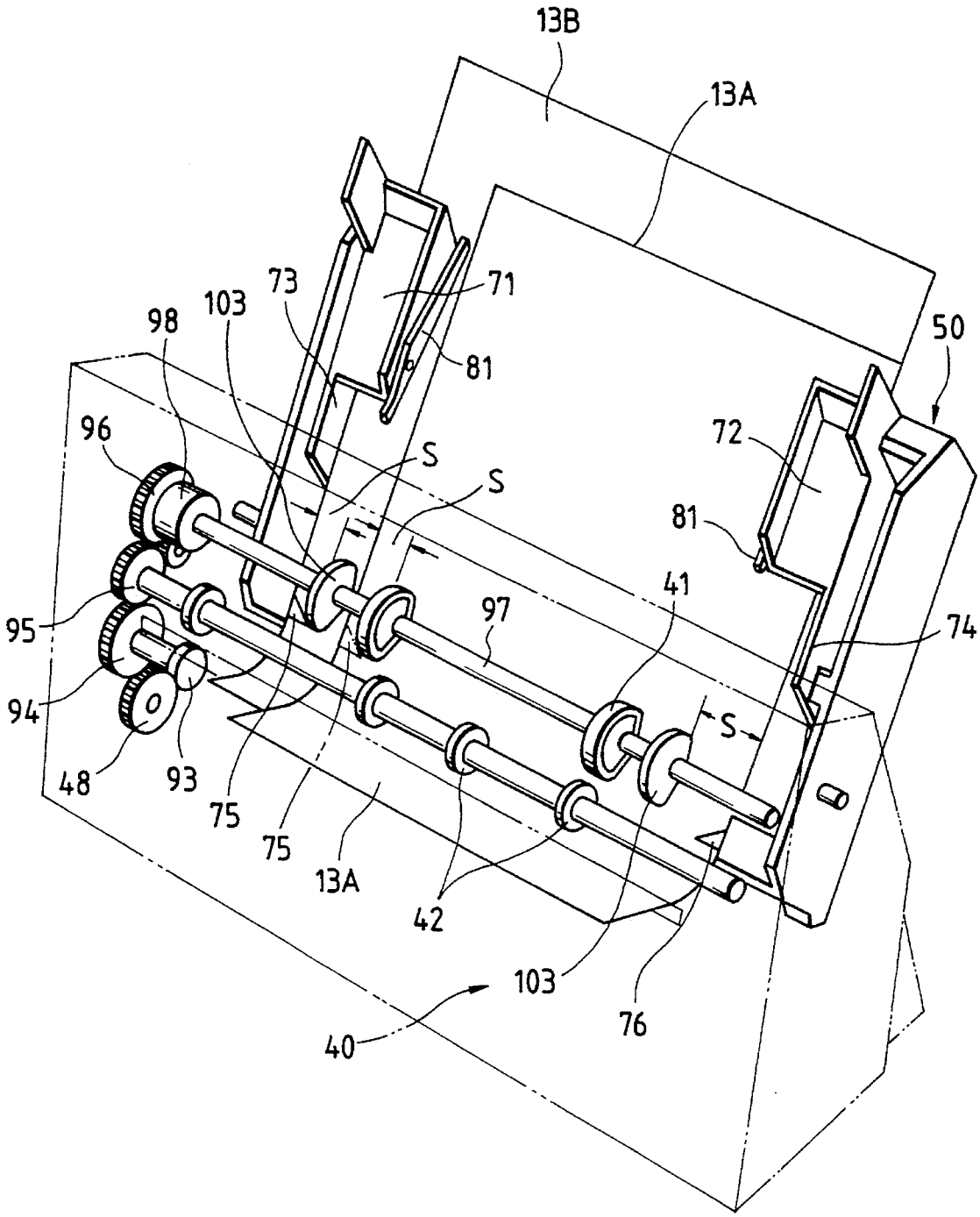
FIG. 14 is the partially omitted diagonal view to show typically the driving mechanism of sheet feeding roller of automatic sheet feeding apparatus is of FIG. 9.

FIG. 14 is a diagonal view to indicate the arrangement of the sheet feeding roller 41 and the driving system of sheet feeding roller 41, in which FIG. 14, the rotation of the driven gear 48 which turns in synchronous with sheet feeding to recording apparatus 10 is transmitted to the sheet feeding roller shaft 97 via the gears 93, 94, 95 and 96.

Here a clutch 98 is provided in between the gear 96 and sheet feeding roller shaft 97. The clutch 98 used here may have, for example, such composition as to function as follows:

In synchronous with the rotation of sheet transporting roller (platen roller) 14 in the reverse direction of printing for the preset amount, which is effected according to the sheet feeding signal, the spring clutch means makes reverse turn and the engagement with the hook in printing direction is released and clutch 98 is changed over form OFF to ON.

By turning the sheet feeding roller (semicircular roller) 41 in synchronization with the rotation of platen roller 14 in the printing direction for preset amount with the clutch at ON position, one recording sheet 13 is separated and one sheet is fed up to the position surpassing the sheet drawing-in section of platen roller 14. Then, by turning the platen roller 14 in the reverse direction of printing for preset amount, the front end of the recording sheet 13 is made to retract to the position escaping from the sheet drawing-in section while the rotation of semicircular sheet feeding roller 41 is stopped. Next, by the rotation of platen roller 14 and sheet feeding roller 41 in the printing direction, the recording sheet 13 is carried to the printing position, the clutch becomes OFF and sheet feeding roller 41 produced in between the said roller 41 and the recording sheet 13 and thus synchronization between platen roller 14 and sheet feeding roller 41 is released. Thus, only one recording sheet 13 is fed as sheet feeding roller 41 makes one rotation.

As explained in FIGS. 11 and 12, side guides 73, 74 which execute width control of the recording sheet 13 and separation claws 75, 76 which engage with the recording sheet 13 at both sides of its front end are provided to the sliders 71, 72 which adjust the space in width direction according to the width of the loaded recording sheet 13. These members are operated together by manual control and by setting the clamp levers 101, 102 (FIGS. 11 and 12) at the position as shown in the drawing, the guide groove (not shown in the drawing) is clamped from both sides by the edge cam means (not shown in the drawing) and thus the groove is set at the position suitable for the specified width by friction force.

On the other hand, the sheet feeding roller 41 is fixed on the sheet feeding roller shaft 97 so that it should not move in the width direction either.

A pair of rollers are used for the sheet feeding roller 41and they are arranged at the specified position and space as shown in FIGS. 12 and 14. Two semicircular sheet feeding rollers 41 and 41 are so arranged that when a small size recording sheet 13A is loaded, the space S, S up to the separation claws 75, 76 located at the outside becomes the proper range (or value) suitable for displaying separation function.

A pair of dummy rollers 103, 103 are fixed at outside of the two sheet feeding rollers 41, 41 of the said sheet feeding roller shaft 97. These dummy rollers 103, 103 have the same profile as the sheet feeding rollers 41, 41 but the material of construction and width of rollers are different and their friction resistance with the recording sheet 13 is smaller and therefore although they slidingly contact the sheet during sheet feeding but sheet delivery force is not produced thereby.

For example, the outer cricumference of the sheet feeding rollers 41, 41 is made of rubber etc. which produces a large friction force but that of the dummy rollers 103, 103 is made of plastics such as Teflon or Nylon® and their outer circumference is made smooth.

Both or one of the dummy rollers 103, 103 are arranged at such position that when recording sheet 13B of large or medium size is loaded, the space up to the separation claws 75, 76 at its outside should become a proper range (or value) suitable for the separation function as stated above.

By additionally providing the dummy rollers 103, 103 having such simple construction, the space between the separation claws 75, 76 and the inside sheet holding position is set within the proper range (proper value) to form an appropriate loop at front end of the recording sheet at the start of sheet feeding, even when recording sheets of different widths are used and the sheet feeding rollers 41, 41 are fixed in axial direction. That is, even when the sheet width varies, it is possible to maintain the proper loop forming position while employing the two fixed sheet feeding rollers 41, 41. Therefore, it is unnecessary to use the expensive sliding rollers (making axial direction sliding) for sheet feeding rollers 41, 41 and it contributes to cost reduction.

Besides, when sliding rollers are used for sheet feeding rollers 41, 41, friction resistance increases at the adjustment of width and the margin of overlap of recording sheet 13 and separation claws 75, 76 tends to fluctuate and reliability of sheet feeding action decreases but when the aforesaid dummy rollers 103,103 as used in the present application of invention are used, such disadvantage is eliminated.

It is also possible to use sheet feeding rollers 41, 41 instead of dummy rollers 103, 103, using in total four sheet feeding rollers. However with such set-up, it is practically impossible to obtain a uniform contact pressure against the recording sheet 13 at all four rollers and the sheet delivery forces at four sheet feeding rollers will vary and it may cause slanted movement of sheet, thus it is practically impossible to employ such system.

Figure 15:
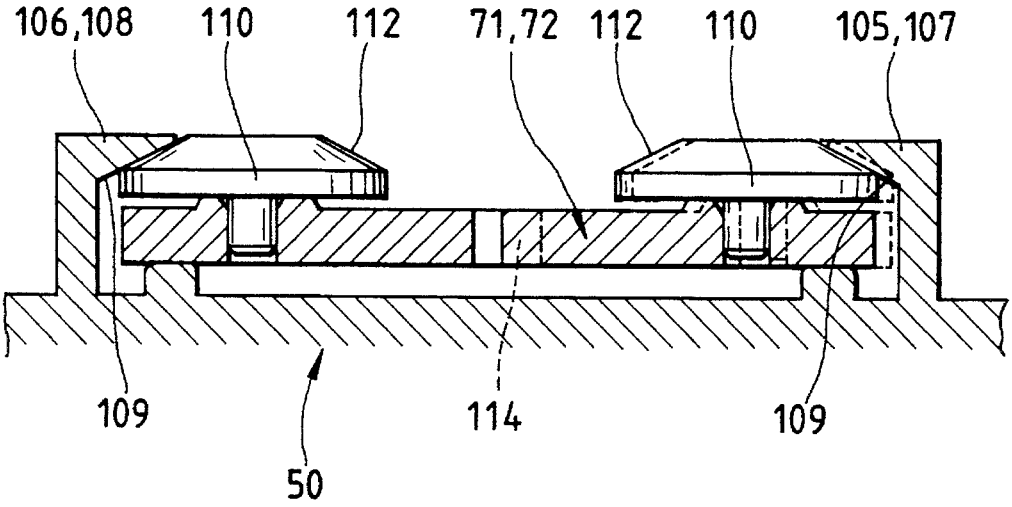
FIG. 15 is the longitudinal sectional drawing to show typically the guide roller of the slider along the line XV—XV in FIG. 11.

In reference to FIG. 11 and FIG. 15 which is the partial sectional drawing along line XV—XV of FIG. 11, the construction of guides of the aforesaid sliders 71, 72 is explained.

In both drawings, the guide rails 105, 106, 107 and 108 are provided at the inner surface of the casing of sheet feeding cassette 50 and the slider 71 at the left side is guided by the guide rails 105 and 106 and the slider 72 at the right side is guided by the guide rails 107 and 108.

The aforesaid guide rails 105 through 108 may be made of the two connected guide rails above and below but in the present embodiment, it is partially installed in the range to cover the maximum range of motion of the sliders 71 and 72. The guide rails 105 through 108 are made of the dovetail guide rail which has dovetail groove (a groove with tapered plane) 109 at inside as shown in FIG. 15.

In the example shown in the Figure, the guide rails 105 through 108 are formed into one piece with the main body of the plastic casing of sheet feeding cassette 50.

A guide roller 110 which rotates while being in contact with the said dovetail groove 109 of the guide rails 105 through 108 is axially and rotatably supported by each of the sliders 71 and 72. In case of the example shown in the drawing, one upper and two lower guide rollers in total three guide rollers 110 are axially supported by each of the sliders 71, 72 as shown in FIG. 11 and sloped planes (having roughly identical angle of slope) 112 engaging with the sloped plane of the corresponding dovetail groove 109 are formed at each guide roller 110 as shown in FIG. 15.

Thus, at the adjustment of width to match the side guides 73 and 74 with the recording sheet 13, the sloped plane 112 of each guide roller 110 is brought in contact with each dovetail groove 109 and thus one or both of the sliders 71 and 72 are made to move (with the construction of FIG. 11, width adjustment is made by moving mainly the left side slider 71 only as illustrated in FIG. 14).

At such time, each guide roller 110 rotatory moves along the sloped plane of dovetail groove 109 and consequently the resistance against its movement is substantially reduced.

Further, at least the guide roll at one side of the sliders 71 and 72, that is, in the example shown in the drawing, the upper side guide roller 110 of the slider 71 and 72 is supported by an elastic means so that it contacts the guide plane (sloped plane) of dovetail groove 109 at the specified pressure.

In the example shown in the drawing, the guide roller supporting part of sliders 71, 72 is formed by an arm section (elastic section) 114 which can make elastic displacement and the width of the upper and lower guide rollers in free state are set at the distance somewhat larger than the space between the upper and lower rails 105, 106 or 107, 108 so that a preliminary contact pressure is produced at the guide plane of each guide roller 110 when the sliders 71 and 72 couple with the guide rails 105 through 108.

By supporting the guide roller 110 via the elastic means which produces the specified contact pressure, the play at the guide section is eliminated and it becomes possible to make the sliders 71, 72 move more smoothly and accurately.

What is claimed is:

1. An image forming device comprising a recording apparatus and an automatic sheet feeding unit detachably mounted to the recording apparatus, comprising:

a first sheet transporting path formed in a U-shape for introducing a sheet to a printing portion and for discharging the sheet when said apparatus is used in a horizontal posture; and a second sheet transporting path formed straight for introducing the sheet to said printing portion when said apparatus is used in a vertical posture, wherein said automatic sheet feeding unit is mounted to said recording apparatus in a vertical posture opposing said second sheet transporting path, said feeding unit being provided with a sheet feeding cassette and supply means for supplying the sheet from said sheet feeding cassette, wherein said sheet feeding cassette is movable between an operating position where said cassette is opened from said unit and a non-operating closed position moved toward said unit so as to close or open a manual sheet inserting port in response to an open-close operation of said sheet feeding cassette, and wherein a manual sheet inserting path is provided in said unit to extend generally straight from said manual sheet inserting port to said second sheet transporting path.

2. An image forming device according to claim 1, wherein at least one sheet transporting path is inclined upward facing a discharge aperture when said recording apparatus is in the vertical posture.

3. An image forming device according to claim 2, wherein said second sheet transporting path is inclined at an angle of 5° to 25°.

4. A recording apparatus according to claim 1, wherein a discharge tray is provided at said discharge aperture.

5. An image forming device according to claim 4, wherein said discharge tray becomes a sheet feeding tray for a sheet inserting aperture when said recording apparatus is in the horizontal posture.

6. An image forming device according to claim 2, wherein said recording apparatus is mounted on said automatic sheet feeding unit inclined at an angle.

7. An image forming device according to claim 1, wherein said recording apparatus is inclined from its vertical posture and supported by said automatic sheet feeding unit in an inclined position when said recording apparatus is in operation.

8. An image forming device according to claim 7, wherein said automatic sheet feeding unit comprises extendable supports, said supports extending for supporting said automatic sheet feeding unit in said inclined position.

9. A recording apparatus according to claim 8, wherein a lower part of said automatic sheet feeding unit comprises a movable member which rotates in a direction to form said extended supports.

10. A recording apparatus according to claim 9, wherein said recording apparatus further comprises a change-over switch provided at a position facing said lower part of said automatic sheet feeding unit, whereby when said supports are extended, said change-over switch is operable.

11. A recording apparatus according to claim 9, wherein said movable member rotates in a direction such that a part of said movable member forms a substantially linear table for supporting sheets manually fed into said recording sheet transporting route.

12. An image forming device according to claim 1, further comprising a driving gear and a driven gear for transmission of a rotary force to drive a sheet feeding roller, said driving gear and said driven gear being axially supported by said recording apparatus and said automatic sheet feeding unit, respectively; and a connecting means, provided with a spring, connects said automatic sheet feeding unit to said recording apparatus in a pressure-contact state, wherein said recording apparatus comprises a frame which is provided with contact surfaces for pressing against said automatic sheet feeding unit.

13. A recording apparatus according to claim 12, wherein said recording apparatus supports said driving gear at a location near said driven gear.

14. A recording apparatus according to claim 12, wherein said automatic sheet feeding unit is mounted on said recording apparatus in said pressure-contact state by engaging a rack provided on said frame with a movable hook enforced by a spring provided on said automatic sheet feeding unit.

15. An image forming device according to claim 1, wherein an image is formed by applying thermal energy to a recording liquid to form droplets thereof.

16. An image forming device according to claim 1, wherein said recording apparatus and said automatic sheet feeding unit are mutually positioned by positioning means with opposing connecting surfaces and locked by hooking means to effect a locked condition, and said hooking means is movable between an operating position and a non-operating position as well as in a connected direction and a non-connected direction, and has applied against it a biasing force generated by an elastic member and acting in a direction crossing said connecting surfaces.

17. An image forming device comprising a recording apparatus and an automatic sheet feeding unit detachably mounted to the recording apparatus, said recording apparatus being usable in a horizontal posture in which said apparatus extends longer in a horizontal direction than in a vertical direction, and in a vertical posture in which said apparatus extends longer in the vertical direction than in the horizontal direction, said recording apparatus comprising:

a first sheet transporting path used in the horizontal posture for introducing the sheet to a printing portion and for discharging the sheet; and a second sheet transporting path, an inlet of which is formed on a surface that is a bottom surface in the horizontal posture, and used in the vertical posture for introducing the sheet to the printing portion, wherein said automatic sheet feeding unit is mounted, in a vertical posture where said feeding unit extends longer in the vertical direction than in the horizontal direction, to said recording apparatus opposing said second sheet transporting path of said recording apparatus in the vertical posture; and after completion of mounting of said automatic sheet feeding unit, a side surface of said feeding unit in the vertical posture of said sheet feeding unit contacts said bottom surface of said recording apparatus, wherein said recording apparatus and said automatic sheet feeding unit are mutually positioned by positioning means with opposing connecting surfaces and locked by hooking means to effect a locked condition, and said hooking means is movable between an operation position and a non-operating position as well as in a connecting direction and a non-connecting direction, and has applied against it a biasing force generated by an elastic member and acting in a direction crossing said connecting surfaces.

18. An image forming device according to claim 17, wherein said recording apparatus comprises a sheet inserting aperture and a sheet discharge aperture at an upper surface of said recording apparatus, said second sheet transporting path connects said second sheet inserting aperture and said sheet discharge aperture.

19. An image forming device according to claim 18, wherein said automatic sheet feeding unit comprises sheet feeding means, which automatically feeds and guides sheets to said inlet of said second sheet transporting path, and manual sheet guiding means which manually guides the sheets to said inlet.

20. A recording apparatus according to claim 17, wherein an image is formed by applying thermal energy to a recording liquid to form droplets thereof.

21. An image forming device according to claim 17, wherein the side surface is inclined, and said recording apparatus held is inclined so that an outlet of the second sheet transporting path is positioned higher than the inlet.

22. An automatic sheet feeding unit removably mountable onto a recording apparatus, said recording apparatus being characterized by being usable in a horizontal posture, in which said recording apparatus extends longer in a horizontal direction than in a vertical direction, and in a vertical posture in which said recording apparatus extends longer in the vertical direction than in the horizontal direction; said recording apparatus including a first sheet transporting path used in the horizontal posture for introducing a sheet to a printing portion and for discharging the sheet, and a second sheet transporting path used in the vertical posture for introducing the sheet to a printing portion; said automatic sheet feeding unit being characterized by:

being mountable in a vertical posture where said automatic sheet feeding unit extends longer in a vertical direction than in the horizontal direction, to said recording apparatus opposing said second sheet transporting path of said recording apparatus in the vertical posture;

being provided with an abut surface abutting against a bottom surface of said recording apparatus, and engage means formed on said abut surface to be engaged with an engage portion of said recording apparatus; and said sheet feeding unit being capable of standing by itself when removed from said recording apparatus.

23. An automatic sheet feeding unit according to claim 22, wherein the side surface is inclined, and said recording apparatus held is inclined so that an outlet of the second sheet transporting path is positioned higher than the inlet.

24. An image forming device comprising a recording apparatus and an automatic sheet feeding unit detachably mounted to said recording apparatus, said recording apparatus including:

a first sheet transporting path for introducing a sheet to a printing portion and for discharging the sheet, wherein said automatic sheet feeding unit is mounted to said recording apparatus opposing said first sheet transporting path and includes a second sheet transporting path for introducing the sheet to said first sheet transporting path;

said recording apparatus and said automatic sheet feeding unit are positioned by positioning means with connecting surfaces opposed to each other and are locked by hooking means to effect a connected condition; and said hooking means is movable between an operating position and a non-operating position as well as in a connecting direction and a non-connecting direction, and has applied against it a biasing force generated by an elastic member and acting in a direction crossing to said connecting surfaces.

25. An image forming device according to claim 24, wherein said recording apparatus and said automatic sheet feeding unit are connected by a gear train, said gear train being divided into a first part for attaching to said feeding unit and a second part for attaching to said recording apparatus, when said feeding unit is disengaged from said recording apparatus.

26. An automatic sheet feeding unit removably mounted onto a recording apparatus, said recording apparatus being provided with at least a sheet transporting path formed straight for introducing the sheet to a printing portion when said apparatus is used in a vertical posture, said automatic sheet feeding unit being characterized by:

being mountable to said recording apparatus in the vertical posture opposing said sheet transporting path;

being provided with a sheet feeding cassette and supply means for supplying the sheet from said sheet feeding cassette;

said sheet feeding cassette being movable between an operating position where said cassette is opened from said unit and a non-operating closed position moved toward said unit, so as to close or open a manual sheet inserting port in response to an open-close operation of said sheet feeding cassette;

a manual sheet inserting path being provided in said unit to extend generally straight from said manual sheet inserting port to said sheet transporting path; and said sheet feeding unit being capable of standing by itself when removed from said recording apparatus.

27. An automatic sheet feeding unit removably mountable onto a recording apparatus, said recording apparatus being characterized by being usable in a vertical posture and in a horizontal posture, said recording apparatus including a sheet transporting path used in the vertical posture for introducing the sheet to a printing portion; said automatic sheet feeding unit being characterized by:

being mountable in a vertical posture to said recording apparatus opposing an inlet of said second sheet transporting path of said recording apparatus in the vertical posture;

being provided with an inclining abut surface abutting against an opposing surface of said recording apparatus and holding said recording apparatus with inclining so that a side of the outlet is higher than a side of the inlet, and engage means formed on said abut surface to be engaged with an engage portion of said recording apparatus; and said sheet feeding unit being capable of standing by itself when removed from said recording apparatus.

28. An image forming device comprising a recording apparatus and an automatic sheet feeding unit detachably mounted to the recording apparatus, said recording apparatus being usable in a horizontal posture, and in a vertical posture, said recording apparatus comprising:

a sheet transporting path used in the vertical posture for introducing the sheet to the printing portion, wherein said automatic sheet feeding unit is mounted, in a vertical posture, to said recording apparatus opposing an inlet of said sheet transporting path of said recording apparatus in the vertical posture; and after completion of mounting of said automatic sheet feeding unit, an inclining side surface of said feeding unit holds said recording apparatus in the vertical posture thereof with inclining so that a side of the outlet is higher than a side of the inlet.

* * * * *

UNITED STATES PATENT AND TRADEMARK OFFICE

CERTIFICATE OF CORRECTION

PATENT NO. : 5,454,555

DATED : October 3, 1995

INVENTOR(S) : TAKEHIKO KIYOHARA, ET AL.

It is certified that error appears in the above-indentified patent and that said Letters Patent is hereby corrected as shown below:

On the title page, item [73],
line Assignee, "Canon kabushiki Kaisha" should read --Canon Kabushiki Kaisha--.

item [56],
line USPD, insert --3,339,916 9/67 Tregay, 3,378,252 4/68 Springer, 3,807,725 4/74 Bookless, 4,027,872 6/77 Bueker, 4,031,995 6/77 Blum et al., 4,273,456 6/81 Bisczat et al., 4,492,371 1/85 Kan et al., 4,540,297 9/85 Imaizumi, et al., 4,729,557 3/88 Kiyohara, 5,096,182 3/92 Kashimura--;
line FPD, insert --58-47733 3/83 Japan, 62-191334 8/87 Japan, 63-282030 11/88 Japan, 1-214541 8/89 Japan, 227116 7/87 Europe, 332275 9/89 Europe--; and
line OP, insert --M.S. Robbins, "Buckle Effect Document Separator", June 1982, IBM Technical Disclosure Bulletin, p. 272--.

[57] ABSTRACT,
line 2, "a" should be deleted.

Column 6,
line 43, "is" should be deleted.

UNITED STATES PATENT AND TRADEMARK OFFICE

CERTIFICATE OF CORRECTION

PATENT NO. : 5,454,555
DATED : October 3, 1995
INVENTOR(S) : TAKEHIKO KIYOHARA, ET AL.

It is certified that error appears in the above-indentified patent and that said Letters Patent is hereby corrected as shown below:

Column 7,
line 44, "deliver." should read --delivered.--
Column 11,
line 60, "pressrue" should read --pressure--.
Column 12,
line 30, "in synchronous" should read --synchronously--;
line 37, "synchronous" should read --synchronism--; and
line 42, "form" should read --from--.
Column 14,
line 19, "said" should be deleted;
line 38, "roll" should read --roller--; and
line 66, "formed" should read --generally formed--.
Column 15,
line 9, "is movable" should read --includes means for moving--;
line 25, "A recording apparatus" should read --An image forming device--, claim 1," should read --claim 2,--;

UNITED STATES PATENT AND TRADEMARK OFFICE

CERTIFICATE OF CORRECTION

PATENT NO. : 5,454,555
DATED : October 3, 1995
INVENTOR(S) : TAKEHIKO KIYOHARA, ET AL.

It is certified that error appears in the above-indentified patent and that said Letters Patent is hereby corrected as shown below:

Column 15 cont'd,
line 43, "A recording apparatus" should read --An image forming device--;
line 47, "A recording apparatus" should read --An image forming device--; and
line 52, "A recording apparatus" should read --An image forming device--.

Column 16,
line 1, "A recording apparatus" should read --An image forming device--;
line 4, "A recording apparatus" should read --An image forming device--; and
line 62, "apparatus," should read --apparatus, and--.

Column 17,
line 4, "A recording apparatus" should read --An image forming device--;
line 21, "portion; said" should read --portion; said recording apparatus further including a driving gear; and said--;
line 29, "surface" should read --surface for--;

UNITED STATES PATENT AND TRADEMARK OFFICE

CERTIFICATE OF CORRECTION

PATENT NO. : 5,454,555 
DATED : October 3, 1995
INVENTOR(S) : TAKEHIKO KIYOHARA, ET AL.

It is certified that error appears in the above-indentified patent and that said Letters Patent is hereby corrected as shown below:

Column 17 cont'd,
line 30, "and" should be deleted;
line 31, "to be engaged" should read --for engaging--;
line 32, "apparatus; and" should read --apparatus, a driven gear to be engaged with the driving gear of said recording means, and sheet supply means driven by the driven gear; and
being provided with connecting means for connecting said sheet feeding unit to said recording apparatus in a pressure contact state.--;
lines 33 and 34, delete lines 33 and 34;
line 36, "the" should read --a--; and
line 58, "to" should be deleted.
Column 18,
line 12, "being movable" should read --includes means for moving--;
line 34, "second" should be deleted; and
line 37, "surface" should read --surface for--.

Signed and Sealed this
Fifth Day of March, 1996

Bruce Lehman

*Attest:*

BRUCE LEHMAN

*Attesting Officer*

*Commissioner of Patents and Trademarks*